US011608608B2

(12) United States Patent
De Waard et al.

(10) Patent No.: US 11,608,608 B2
(45) Date of Patent: Mar. 21, 2023

(54) DEVICE FOR PUSHING FOUR PILES INTO THE GROUND OR INTO A SEABED

(71) Applicant: Heerema Marine Contractors Nederland SE, Leiden (NL)

(72) Inventors: Onno Ludolf De Waard, Leiden (NL); Marius Gabriël Ottolini, Leiden (NL); Jurgen Albertus De Jong, Leiden (NL)

(73) Assignee: HEEREMA MARINE CONTRACTORS NEDERLAND SE, Leiden (NL)

( * ) Notice: Subject to any disclaimer, the term of this patent is extended or adjusted under 35 U.S.C. 154(b) by 0 days.

(21) Appl. No.: 17/283,469

(22) PCT Filed: Oct. 7, 2019

(86) PCT No.: PCT/NL2019/050667
§ 371 (c)(1),
(2) Date: Apr. 7, 2021

(87) PCT Pub. No.: WO2020/076152
PCT Pub. Date: Apr. 16, 2020

(65) Prior Publication Data

US 2022/0010517 A1 Jan. 13, 2022

(30) Foreign Application Priority Data

Oct. 8, 2018 (NL) ..... 2021775

(51) Int. Cl.
*E02D 7/06* (2006.01)
*B63B 3/48* (2006.01)
(Continued)

(52) U.S. Cl.
CPC ..... *E02D 7/06* (2013.01); *B63B 3/48* (2013.01); *B63B 35/03* (2013.01); *E02D 7/16* (2013.01); *E02D 13/04* (2013.01); *E02D 5/24* (2013.01)

(58) Field of Classification Search
CPC ..... E02D 7/06; E02D 13/04; E02D 27/525; E02D 7/02; E02D 27/14; E02D 7/00;
(Continued)

(56) References Cited

U.S. PATENT DOCUMENTS 9,157,208 B2 10/2015 Ong
2007/0144360 A1* 6/2007 Heichel ..... E02D 7/18 100/137
(Continued)

FOREIGN PATENT DOCUMENTS

EP 2574698 A1 4/2013
GB 1496536 A 12/1977
(Continued)

OTHER PUBLICATIONS

Netherlands Search Report and Written Opinion dated Apr. 2, 2019, corresponding to Application No. 2021775.
International Search Report and Written Opinion dated Apr. 8, 2020, corresponding to Application No. PCT/NL2019/050667.

*Primary Examiner* — Carib A Oquendo
(74) *Attorney, Agent, or Firm* — Patterson + Sheridan, LLP

(57) ABSTRACT

The present invention relates to a device for pushing four piles into the ground or into a seabed in a square configuration or in a diamond configuration, the device comprising: —a bridge assembly which defines a first, second, third and fourth connecting location arranged in a square or diamond configuration, —four connection assemblies via which in use each of the four piles is connected to the bridge assembly, wherein each pile connection assembly com-
(Continued)

prises: ○an actuator comprising an upper actuator part and a lower actuator part, wherein the actuator is configured to extend, ○a pile connector connected to the lower actuator part, ○a control device configured for alternately letting each of the actuators extend, and configured for letting the pile which is pushed into the ground or seabed receive a greater force than the opposite pile of the square or diamond configuration, wherein the exerted push force is transferred into the bridge assembly and transferred at least partially from the bridge assembly as a tension force and a bending moment into the two adjoining piles via the two adjoining pile connection assemblies.

15 Claims, 35 Drawing Sheets

(51) Int. Cl.

| | |
|---|---|
| ***B63B 35/03*** | (2006.01) |
| ***E02D 7/16*** | (2006.01) |
| ***E02D 13/04*** | (2006.01) |
| *E02D 5/24* | (2006.01) |

(58) Field of Classification Search
CPC ..... E02D 7/26; E02B 17/02; B63B 3/48; B63B 35/03; B63B 35/44
See application file for complete search history.

(56) References Cited

U.S. PATENT DOCUMENTS

| | | | | |
|---|---|---|---|---|
| 2011/0222968 | A1* | 9/2011 | Ong | E02D 7/14 405/232 |
| 2012/0014753 | A1* | 1/2012 | Jung | E02D 13/00 405/244 |
| 2013/0243532 | A1* | 9/2013 | Lynderup | E02B 17/02 405/232 |
| 2015/0023738 | A1* | 1/2015 | Van Vessem | E02D 27/52 405/228 |
| 2015/0147121 | A1* | 5/2015 | Hall | F16C 23/045 384/147 |
| 2015/0233079 | A1* | 8/2015 | Halkyard | E02D 27/52 405/228 |
| 2016/0138299 | A1* | 5/2016 | Powers, III | E04H 17/263 173/184 |
| 2018/0355575 | A1* | 12/2018 | Huang | E02D 13/04 |
| 2019/0234037 | A1* | 8/2019 | Canteri | E02D 7/06 |
| 2021/0246623 | A1* | 8/2021 | Lammers | E02D 33/00 |
| 2021/0254300 | A1* | 8/2021 | Lammers | E02D 5/285 |

FOREIGN PATENT DOCUMENTS

| | | | |
|---|---|---|---|
| GB | 2448613 | A | 10/2008 |
| WO | 2013122457 | A1 | 8/2013 |

* cited by examiner

DEVICE FOR PUSHING FOUR PILES INTO THE GROUND OR INTO A SEABED

FIELD OF THE INVENTION

The present invention relates to a device for pushing four piles into the ground or into a seabed in a square configuration or in a diamond configuration. Devices for pushing piles into the ground are known in the field of the art.

BACKGROUND OF THE INVENTION

Offshore structures are generally grounded to the seabed with large diameter piles. The piles may be installed through the legs of the structure, so called main piles, or may be installed adjacent to the structure and connected with pile sleeves, so called skirt piles, to the structure. In order to insert these piles into the seabed, hydraulic impact hammers are typically used. The impact of the hydraulic hammer on the pile during a blow radially expands the pile. This expansion in turn results into a pressure wave in the water and soil column.

The noise generated by the pressure wave may be harmful for marine mammals. In some areas regulatory bodies limit the allowed sound levels. Such regions are for instance Germany, where the allowed sound levels are limited to 160 dB SEL5% at 750 m. In order to reduce the sound levels bubble curtains can be deployed prior to installation. These curtains are hoses with holes which lay on the seabed. Air is blown through these hoses, which escapes through the holes. Due to the difference in impedance between the air bubbles and the seawater part of the pressure wave is reflected and energy is dissipated reducing the noise levels significantly.

In order to blow enough air from the bubble curtain, many compressors are required. These are typically positioned on an auxiliary vessel. This is an expensive operation and has a large carbon footprint. Furthermore, the noise during pile driving is only reduced, never fully mitigated. Finally, these bubble curtains only work effectively in shallow water depths and become less efficient at larger depths. Therefore a silent alternative would be preferred both from a sustainability and technical perspective.

A further disadvantage of hammering piles into the ground or seabed is that the shockwaves typically are so strong that they damage electronic equipment which could be used to measure the position and orientation (inclination) of the piles.

There are several options to silently install piles. Typical examples are helical piles installed by torque or piles which are pushed into the ground. The push-in pile is often used on land where multiple piles are installed at the same time. One pile is pushed down while the other piles are used as a reaction force. These piles are installed in one line, to form a row. In the present invention, it was recognized that this is not economical for offshore piles, because the distance between the outermost pile and the jacket would become too large. Currently, there is no viable technology available to drive piles into the seabed in a silent manner.

On land, hammering piles into the ground is common technology and widely used for foundations of buildings and in general structures. However, similar issues apply with regard to noise. The hammering has a disadvantage in that a lot of noise is generated, which provides serious inconvenience to people in the surrounding. The hammering may also form a cause of damage to other buildings, in particular by causing cracks in other buildings.

As indicated above, systems for pushing piles into the ground in a silent matter exist. However, such systems generally have a limitation that the piles need to be positioned in a row. Furthermore, these systems generally require a separate reaction frame for the first few piles, because the system requires a support position in order to be able to start working. Only after a few piles are inserted into the ground, the reaction frame is no longer necessary.

Another system for silently driving piles into the ground exists. This system is applied by a British company called Dawson, called a Dawson system. With this system, four interlocked sheet piles can be driven into the ground. See the website of this company: http://www.dcpuk.com/products-_press.html. This system is considered to form the closest prior art for the present invention.

It was recognized in the present invention that a disadvantage of this Dawson system is that the Dawson system is not capable of driving regular tubular piles into the ground. In the Dawson system, the piles needs to be interlocked, and for this reason need to have a specific design which allows for the interlocking of the piles. Such specially made piles are quite costly.

Other systems for driving piles into the ground in a silent manner also exist. For instance, systems exist for driving piles having a helical shape into the ground. This is essentially screwing a pile into the ground. Although these systems work, the piles need to be specifically designed and manufactured, and are quite costly.

Other systems exist which are based on vibrating piles into the ground. Such systems have a specific disadvantage that the vibrations may also cause inconvenience to people in the surroundings and may be a cause of damage to surrounding buildings. Furthermore, these systems do not work under all circumstances.

OBJECT OF THE INVENTION

It is an object of the invention to provide a device for driving a plurality of piles into the ground or into a seabed in a silent manner wherein the piles do not need to be interlocked.

It is an object of the invention to provide a device for driving a plurality of piles into the ground or into a seabed in a silent manner wherein the piles can be regular tubular piles.

It is an object of the invention to provide a device for driving a plurality of piles into the ground or into a seabed which allows better and/or more accurate measuring of the loads, positions and orientations of the piles, and with less risk of damage to electronic measuring equipment.

SUMMARY OF THE INVENTION

In order to achieve at least one objective, the present invention provides a device for pushing four piles into the ground or into a seabed in a square configuration or in a diamond configuration, the device comprising:

- a bridge assembly which when seen in top view defines a first, second, third and fourth connecting location which are arranged in a square configuration or in a diamond configuration,
- a first, a second, a third and a fourth pile connection assembly via which in use each of the four piles is connected to the bridge assembly, wherein each pile connection assembly comprises:
  - an actuator which extends downward from the respective connecting location, wherein each actuator comprises an upper actuator part and a lower actuator part, wherein the upper actuator part is connected to the bridge assembly, wherein the actuator is configured to extend in order to each time move the lower actuator part downward relative to the upper actuator part in order to push the associated pile over a distance into the ground or seabed, a pile connector connected to the lower actuator part, wherein each pile connector is configured to be connected to an upper end of a pile which is to be pushed into the ground or seabed, wherein the pile connector is configured to move downward relative to the upper actuator part together with the associated lower actuator part during the extension, a control device configured for alternately letting each of the actuators extend, wherein the control device is configured for regulating at least the force which is exerted by the actuator which extends and the force which is exerted by the opposite actuator in order to let the pile which is pushed into the ground or seabed receive a greater force than the opposite pile of the square or diamond configuration, wherein the actuator which extends transfers the exerted push force into the bridge assembly and wherein said push force is transferred at least partially from the bridge assembly as a tension force and a bending moment into the two adjoining piles via the two adjoining pile connection assemblies.

The present invention is based on the general idea that in order to push one pile into the ground, a push force (or compression force) is provided by an actuator connected to the bridge assembly. This push force results in a reaction force of the pile into the bridge assembly. This reaction force is at least partially transferred as a combination of a tension force and a bending moment into both of the piles which adjoin the pile which is pushed into the ground or seabed.

The device is configured to actively maintain the push force on the pile opposite the pile which is to be pushed into the ground at a lower level than the pile which is to be pushed into the ground or seabed. This prevents a situation in which it is unknown which of the two piles will actually be pushed downward. In order to control the forces of the individual actuators, the device comprises a control unit which actively controls the forces in the four actuators. If the actuators are hydraulic actuators, the control unit controls the hydraulic pressures in the four hydraulic actuators.

An advantage of the invention is that the device can be "stand alone". In other words, the device does not generate external loads as land based systems generally do, which external loads have to be carried by a separate crane or structure or foundation.

Another advantage of the device according to the invention is that, in contrast to piles that are installed by pile driving, measurement tools can remain on the equipment. This is normally not possible as the measurement system cannot survive the blows from the hammer. This allows direct read-out of the depths and orientations of the independent piles and/or the tool itself and of the loads which are exerted on the piles.

The device according to the invention is configured to distribute the load over the piles in such a way that one of the piles alternatingly has a significantly larger push force than the opposite pile on the diagonal (of the square of diamond configuration) and a balance of forces is achieved by transferring a part of the load as a combination of tension and bending moments into the piles on the opposite diagonal.

In an embodiment the bridge assembly comprises:

a first pivotable frame which is pivotable about a first pivot axis, a second pivotable frame positioned below the first pivotable frame and being pivotable about a second pivot axis which extends at an angle, in particular at right angles, to the first pivot axis, wherein when seen in top view the first pivotable frame crosses the second pivotable frame, wherein the first actuator and the second actuator are positioned below the first pivotable frame and are connected with the respective upper actuator parts thereof to the first pivotable frame at the first and second connecting locations wherein the third actuator and the fourth actuator are positioned below the second pivotable frame and are connected with the respective upper actuator parts thereof to the second pivotable frame at the third and fourth connecting locations, wherein each pile connection assembly comprises a pair of connector rods, each pair comprising a right connector rod and a left connector rod, wherein:

the right and left connector rod of the first pile connection assembly are connected to the lower actuator part of the first actuator and to the second pivotable frame, the right and left connector rod of the second pile connection assembly are connected to the lower actuator part of the second actuator and to the second pivotable frame, the right and left connector rod of the third pile connection assembly are connected to the lower actuator part of the third actuator and to the first pivotable frame, the right and left connector rod of the fourth pile connection assembly are connected to the lower actuator part of the fourth actuator and to the first pivotable frame, wherein each right connector rod is connected to a right side of the associated actuator and each left connector rod is connected to a left side of the associated actuator, wherein each pair of connector rods is configured to transfer a tension force and a bending moment from the bridge assembly into the associated pile.

In an embodiment, each pile connection assembly comprises a sliding assembly which is rigidly connected to the bridge assembly, wherein the sliding assembly comprises a sleeve and one or more gripper actuators which can be switched between a gripping state and a released state, wherein:

in the released state the pile and/or pile connector can slide through the sleeve, in the gripping state the sleeve is rigidly connected to the pile and/or pile connector, allowing a tension force and a bending moment to be transferred from the bridge assembly into the pile which is in the sleeve.

In an embodiment, the pile connection assemblies are rigidly connected to one another via a base frame which is positioned below the bridge assembly and which is rigidly connected to the bridge assembly via at least one column, wherein the sliding assemblies are connected to the base frame.

In an embodiment each actuator comprises:

a cylinder, a piston rod and a first piston and second piston positioned inside the cylinder and mounted on the piston rod at a distance from one another, and/or a plurality of linear guides positioned at a lateral distance from one another and extending parallel to the direction in which the cylinder actuator extends wherein the linear guides are configured to transfer a bending moment from the upper actuator part to the lower actuator part, a cylinder in which a minimum distance between a piston guide and a rod guide is equal to or greater than a diameter of the cylinder, and/or a first sub-actuator, in particular a cylinder, and a second sub-actuator, in particular a cylinder, positioned adjacent one another.

In an embodiment, in top view the bridge assembly has a square or diamond shape and comprises a central opening, wherein the bridge assembly extends around this central opening.

In an embodiment, the device is configured for pushing piles into the ground or seabed which are not interlocked.

In an embodiment, the device is configured for pushing piles which are positioned at a horizontal distance from one another and do not contact one another.

In an embodiment, each pile connector comprises an insertable part which is configured to be inserted into, the upper ends of tubular piles.

In an embodiment, each pile connector comprises one or more gripper actuators to grip the upper end of the tubular piles.

In an embodiment, the device comprises exactly four connecting assemblies and exactly four pile connectors.

In an embodiment, the device is configured to drive all piles vertically into the ground or seabed, wherein in particular the four actuators and the four pile connectors are oriented vertically.

In an embodiment, the right and left connector rod of each pair are connected to a same side of the associated pivotable frame and to opposite sides of the associated lower actuator part.

In an embodiment, each connector rod is connected to the associated cylinder actuator via a lower hinge, and wherein each connector rod is connected to the associated pivotable frame via an upper hinge.

In an embodiment, the first pivotable frame is pivotable in a first plane and the second pivotable frame is pivotable in a second plane which extends at right angles to the first plane, wherein the first and second plane extend in particular vertically.

In an embodiment, the first, second, third and fourth connecting location are adjustable between an outer location and an inner location respectively with respect to a centre of the bridge assembly.

In an embodiment, a spacing distance between the pile connectors is approximately 0.5 times the diameter of the piles configured to be connected thereto.

In an embodiment, a spacing distance between the pile connectors is 2 times the diameter of the piles configured to be connected thereto or less.

In an embodiment, a spacing distance between the pile connectors is between 2 and 4 times the diameter of the piles configured to be connected thereto.

The present invention further relates to a method of pushing four piles into the ground or into a seabed in a square configuration or in a diamond configuration, the method comprising:

positioning four piles on the ground or on a seabed, in a square or diamond configuration when seen in top view, and connecting the device according to the invention to the upper ends of the piles, wherein each pile connection assembly is connected to an associated pile, alternately pushing each one of the four piles over a distance into the ground or seabed by extending the actuator which is associated with said pile, wherein during the extension the control device regulates the force exerted by the actuator which extends and the force exerted by the opposite actuator in order to let the pile which is pushed into the ground or seabed receive a greater force than the opposite pile of the square or diamond configuration, and wherein an exerted push force is transferred from the respective actuator into the bridge assembly and transferred at least partially from the bridge assembly as a tension force and a bending moment into the two adjoining piles via the two adjoining pile connection assemblies.

The method provides the same advantages as the device.

In an embodiment, the method comprises:

connecting the device according to the invention to the piles, alternately pushing in each one of the four piles over a distance into the ground or seabed by extending the cylinder actuator which is associated with said pile, wherein during each pushing step the required push force is transferred from the respective cylinder actuator into the pivotable frame to which the cylinder actuator is connected and from said pivotable frame at least partially as a tension force and a bending moment into two adjacent piles by the connector rods which are connected to said pivotable frame and to the two adjacent piles.

In an embodiment of the method, the piles are tubular piles.

In an embodiment of the method, the piles are not interlocked and are in particular positioned at a horizontal distance from one another.

In an embodiment of the method, the bridge assembly moves downward together with the piles as they are pushed into the ground.

In an embodiment of the method, during the extension of an actuator the pivotable frame which is connected to the upper part of said actuator is maintained stationary and the other pivotable frame pivots.

In an embodiment, the method comprises:

positioning four piles in an square or diamond configuration in a temporary location, connecting the device according to the assembly to the four upper ends of the four piles, lifting the combination of the device and the four piles connected thereto to a target location on a seabed or on the ground.

In an embodiment of the method each cycle comprises the following steps in the sequence as indicated:

pushing the first pile over a distance into the ground or seabed, pushing the second pile which is opposite to the first pile over a distance into the ground or seabed, pushing the third pile over a distance into the ground or seabed, pushing the fourth pile which is opposite to the third pile over a distance into the ground or seabed.

In an embodiment of the method, the device is lifted by a crane on an installation vessel at sea.

In an embodiment of the method, four piles are pushed into the ground through piles sleeves at each leg of a jacket.

The present invention further relates to a pile support frame, wherein the pile support frame is configured to support four piles in a square or diamond pickup configuration and in a substantially vertical orientation and parallel to one another, wherein the pile support frame is open at an upper side, allowing the four piles to be gripped by the device according to any of claim 1-15.

In an embodiment, the pile support frame comprises pile supports which are configured to support the piles at a distance from one another and with the upper end faces of the piles substantially flush.

The present invention further relates to a vessel comprising:

the device according to the invention, a pile support frame, and a crane.

In an embodiment of the vessel, the pile support frame:

positioned on deck, is located at least partially below a deck, comprises a cantilever platform which extends outwardly away from the hull or deck of the vessel, located at least partially in a column of a semi-sub, wherein the column connects a deck structure with a floater.

These and other aspects of the invention will be more readily appreciated as the same becomes better understood by reference to the following detailed description and considered in connection with the accompanying drawings in which like reference symbols designate like parts.

DETAILED DESCRIPTION OF THE FIGURES

Figure 1:
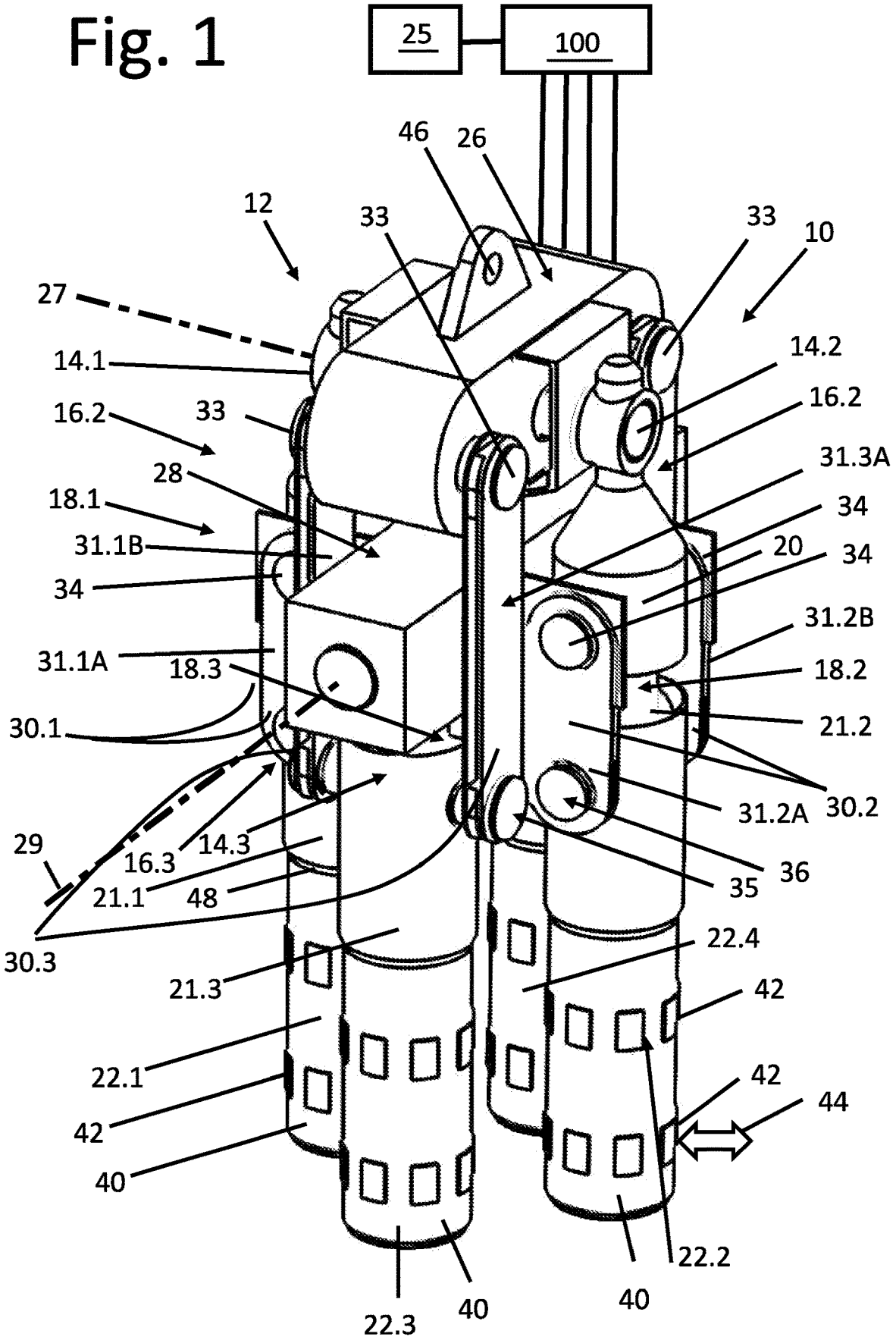
FIG. 1 shows an isometric view of a first embodiment according to the invention.
Figure 2:
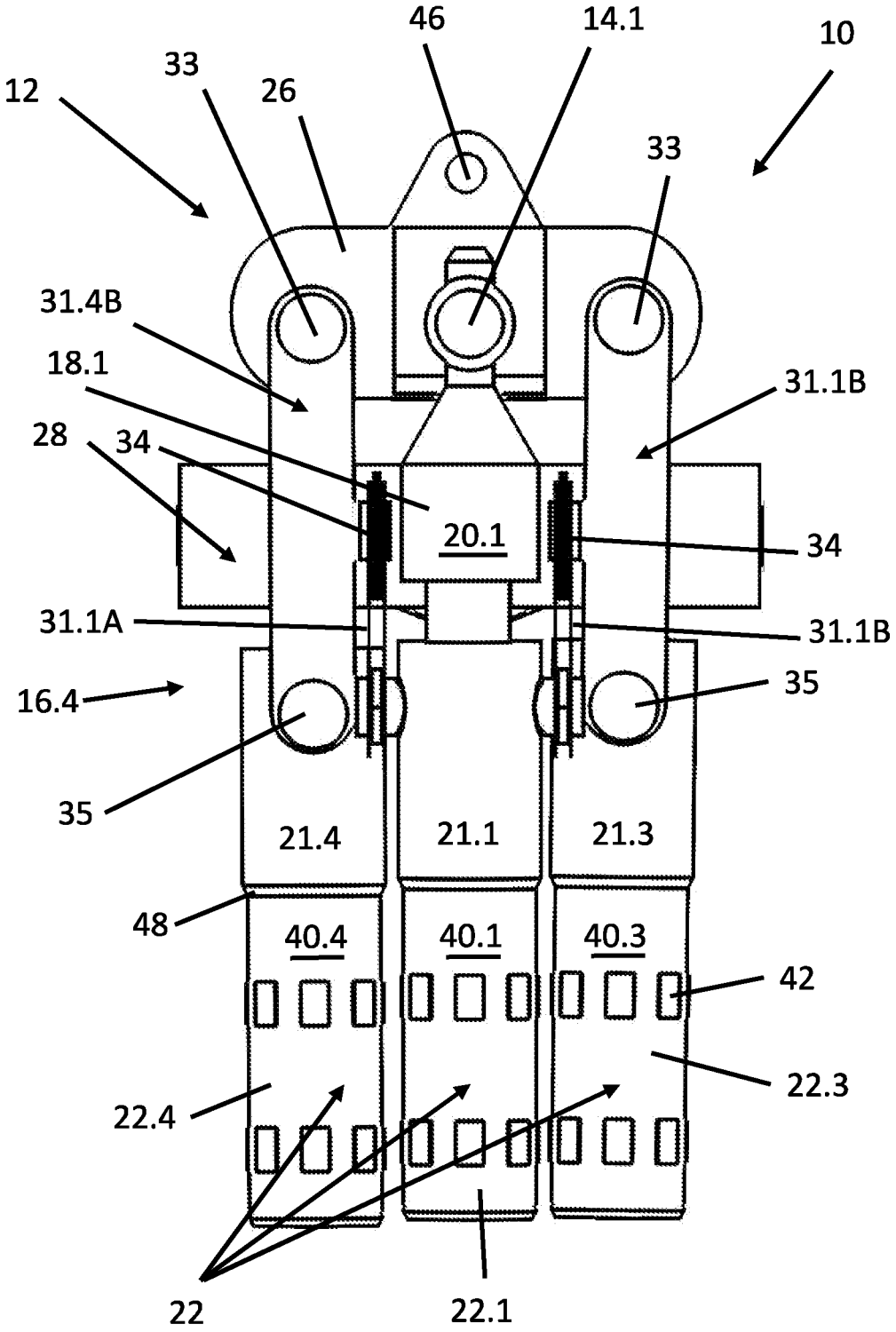
FIG. 2 shows a front view of the embodiment of FIG. 1.
Figure 3:
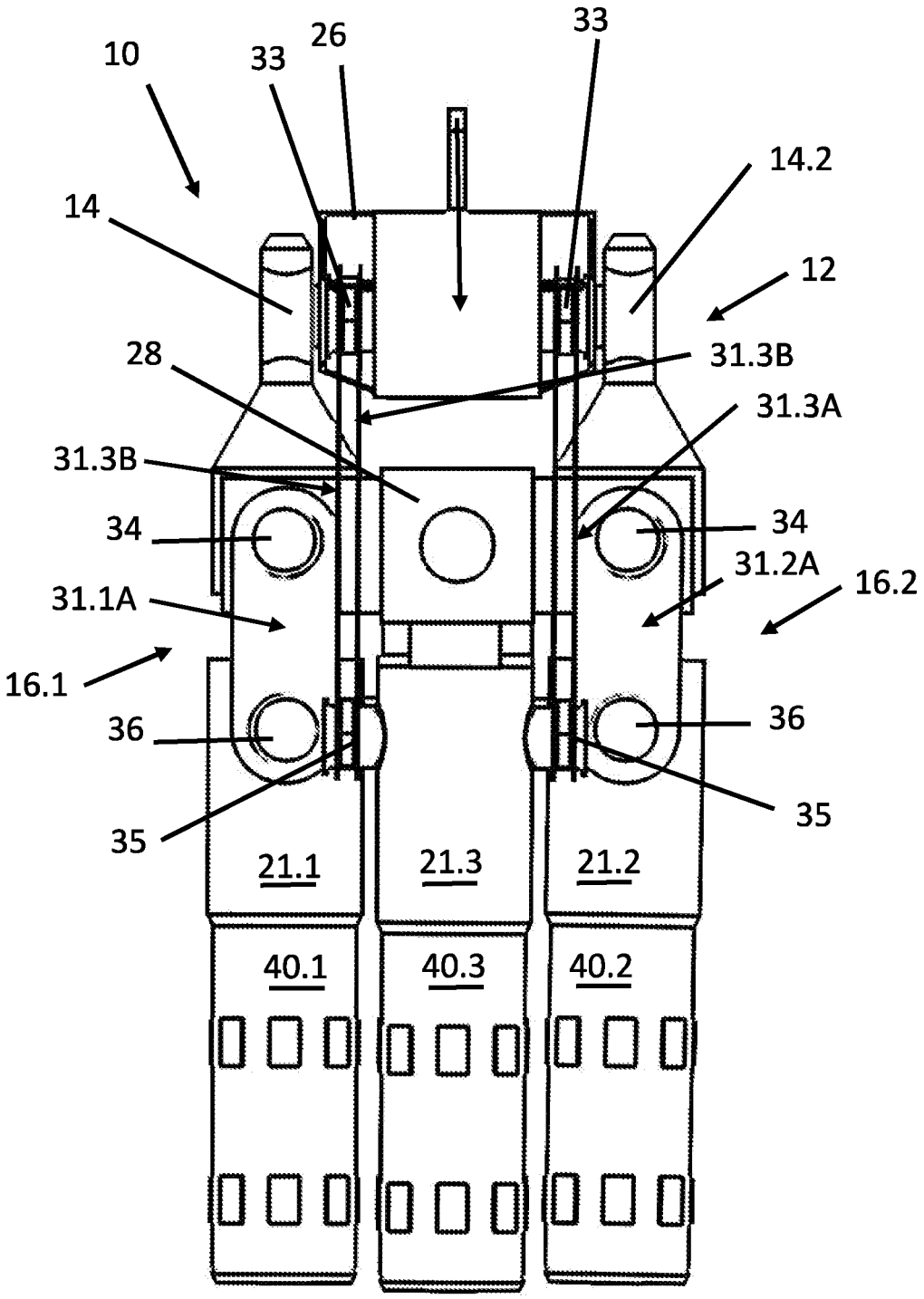
FIG. 3 shows a side view of the embodiment of FIG. 1.

Turning to FIGS. 1, 2 and 3 a first embodiment of the device 10 is shown. The device 10 comprises a bridge assembly 12. The bridge assembly 12—when seen in top view—defines a first, second, third and fourth connecting location 14.1, 14.2, 14.3, 14.4 (generally designated as 14) which are arranged in a square configuration or in a diamond configuration. It is noted that the numbering of the connection locations is chosen such that 14.1 and 14.2 are located opposite one another and 14.3 and 14.4 are also located opposite one another.

Typical centre to centre of the piles (or distance between the connecting locations 14) would be 2 m to 3 m. The pile diameter can be in the order of 1.5 m (1500 mm). The pile length may be 42 m. Obviously, other sizes, diameters and distance are also possible.

During operation part of the piles are loaded in tension and part of the piles are loaded in compression. It was surprisingly found that when the piles are spaced more closely together the increase in tension capacity is larger than the increase in compression capacity. As the compression capacity of piles is generally larger than the tension capacity of piles a result of spacing the piles more closely together is that the difference between the compression capacity and the tension capacity of the piles is reduced. The difference between the compression and tension capacities is compensated by the weight of the device itself and the moment that is taken up by the piles. So an advantage of placing the piles closer together is that either the deadweight of the device can be significantly reduced or the moment acting on the piles can be reduced, or a combination thereof.

The piles may be spaced as closely together as possible. A pile spacing 95 is however limited by the minimum required spacing 96 between the cylinders 18 and the fabrication of the device according to the invention, see FIG. 33. The spacing is 95 limited to approximately half a pile diameter. The pile spacing is substantially equal to the distance between the pile connectors.

It was found that the tension and compression capacity of the piles increase exponentially at a pile spacing of 2 pile diameters and less, wherein the tension capacity has a steeper exponential increase with decreasing pile spacing 95 compared to the compression capacity.

It was further found that a spacing 95 between 2 to 4 pile diameters already has a more or less linearly increasing effect on the difference between tension and compression capacity, with the same advantage of allowing the deadweight of the device to be reduced.

The device 10 comprises a first, a second, a third and a fourth pile connection assembly 16.1, 16.2, 16.3, 16.4 (generally designated as 16) via which in use each of the four piles 1, 2, 3, 4 is connected to the bridge assembly 12. In FIGS. 1, 2, and 3 the piles 1, 2, 3, 4 are not shown.

Each pile connection assembly 16.1, 16.2, 16.3, 16.4 comprises an actuator 18 (individually designated as: 18.1, 18.2, 18.3, 18.4) positioned (when seen in top view) at a respective connecting location and extending downward from the associated connecting location 14. The actuators may be hydraulic actuators. This is the preferred embodiment for offshore use.

However, the actuators 18 may also be electric or pneumatic or be operated on steam. This may in particular be suitable for use on land, and may be suitable for smaller versions of the device 10.

The actuators 18 may be of cylinder type or of a spindle type. In case of a spindle, the spindle may be driven by hydraulic, pneumatic or electric force.

Each actuator 18 comprises an upper actuator part 20 and a lower actuator part 21. The upper actuator part 20 is connected to the bridge assembly 12. The actuator 18 is configured to extend (in length) in order to each time move the lower actuator part 21 downward relative to the upper actuator part 20 in order to push the associated pile over a distance into the ground or seabed.

Each pile connection assembly 16 further comprises a pile connector 22 (individually designated as 22.1, 22.2, 22.3, 22.4) connected to the lower actuator part 21. Each pile connector 22 is configured to be connected to an upper end of a pile which is to be pushed into the ground or seabed.

The pile connector 22 is configured to move downward together with the associated lower actuator part 21 relative to the upper actuator part 20 during the extension of the actuator 18.

For the hydraulic and pneumatic embodiment, the device 10 further comprises a source 25 of hydraulic/pneumatic fluid connected to the four actuators 18 and a control device 100 configured for alternately letting each of the actuators extend. The control device is configured for individually controlling the hydraulic/pneumatic pressures in the actuators 18. The control device 100 is configured for regulating the hydraulic/pneumatic pressures inside the actuator 18 which extends and inside the opposite actuator 18 in order to let the pile which is pushed into the ground or seabed receive a greater force than the opposite pile of the square or diamond configuration. In case of electric actuators, the source or pressurized fluid is obviously not required, and the control device 100 simply controls the forces in the electric actuators 18.

The device 10 may comprise measuring equipment for measuring the position and orientation of the piles 1, 2, 3, 4 relative to the device 10. The measuring equipment may comprise electronic, optic mechanical or acoustic sensors. The sensors may be connected to the control unit 100 for effective control of the entire process. The measuring equipment may further comprise load sensors for measuring the loads which are exerted on the piles.

In the embodiment of FIGS. 1, 2 and, 3, the bridge assembly 12 comprises:

- a first pivotable frame 26 which is pivotable about a first pivot axis 27, and
- a second pivotable frame 28 positioned below the first pivotable frame and being pivotable about a second pivot axis 29 which extends at an angle, in particular at right angles, to the first pivot axis, wherein when seen in top view the first pivotable frame crosses the second pivotable frame, The first pivotable frame 26 is pivotable in a first plane which extends at right angle to the first pivot axis. The second pivotable frame 28 is pivotable in a second plane which extends at right angles to second pivot axis and to the first plane. The first and second pivot axis extend horizontally. The first and second plane extend vertically.

It is noted that the first and second connection locations 14.1 and 14.2 define outer ends of the first pivotable frame 26. The third and fourth connection locations 14.3 and 14.4. define outer ends of the second pivotable frame 28. In the embodiment of FIG. 1, the first and second pivot axis 27, 29 extend orthogonal to one another, when seen in top view.

The first actuator 18.1 and the second actuator 18.2 are positioned below the first pivotable frame 26 and are connected with the respective upper actuator parts 20 thereof to the first pivotable frame at the connection locations 14.1, 14.2. In top view, both connection locations 14.1, 14.2 are located on the first pivot axis 27. The connections locations 14.1, 14.2 are located on opposite sides of the first pivotable frame.

The third actuator 18.3 and the fourth actuator '8.4 are positioned below the second pivotable frame 28 and are connected with the respective upper actuator parts 20 thereof to the second pivotable frame on opposite sides of the second pivotable frame 28, Each pile connection assembly 16 further comprises a pair 30 of connector rods 31. The pairs are individually designated as 30.1, 30.2, 30.3 and 30.4. The connector rods 31 are designated with a digit indicating the connecting assembly 16 to which the connector rod belongs, i.e. 31.1, 31.2, 31.3, 31.4. Further, each pair 30 comprises a right connector rod 31A and a left connector rod 31B, indicated with 31.1A, 31.1B, etc. . . . For the pairs 30.1 and 30.2, "right" is defined as the right side when looking at the device 10 from the side of connecting assembly 16.1. For the pairs 30.3 and 30.4, "right" is defined as the right side when looking at the device 10 from the side of connecting assembly 16.3.

The right and left connector rod 31.1A, 31.1B of the first pile connection assembly 16.1 are connected to the lower actuator part 21 of the first actuator 18.1 and to the second pivotable frame 28. The first and second pivotable frame 26, 28 each comprise upper rod mounting positions 33, 34 for the connector rods 31. The first pivotable frame 26 comprises four upper mounting positions 33, two upper mounting positions 33 for the connector rods 31.3A and 31.3B extending to the lower actuator part 21.3 of the third connecting assembly 16.3 and two upper mounting positions 33 for the connector rods 31.4A and 31.4B extending to the lower actuator part 21.4 of the fourth connecting assembly 16.4. The second pivotable frame 28 comprises four upper mounting positions 34, two upper mounting positions 34 for the connector rods 31.1A, 31.1B extending to the lower actuator part 21.1 of the first connecting assembly 16.1 and two upper mounting 34 positions for the connector rods 31.2A, 31.2B extending to the lower actuator part 21.2 of the second connecting assembly 16.2.

The upper rod mounting positions 33 of the first pivotable frame 26 are located at opposite sides of the first pivot axis 27. The upper rod mounting positions 34 of the second pivotable frame 26 are located at opposite sides of the first pivot axis 29.

Each lower actuator part 21 comprises lower rod mounting positions 35, 36.

Each rod mounting position 33, 34, 35, 36 may comprise a hinge.

The right and left connector rod 31.1A, 31.1B of the first pile connection assembly 16.1 are connected to the lower actuator part 21.1 of the first actuator 18.1 and to the second pivotable frame 28 at the upper rod mounting positions 34 thereof.

The right and left connector rod 31.2A, 31.2B of the second pile connection assembly 16.2 are connected to the lower actuator part 21.2 of the second actuator 18.2 and to the second pivotable frame 28 to the upper rod mounting positions 34 thereof.

The right and left connector rod 31.3A, 31.3B of the third pile connection assembly 16.3 are connected to the lower actuator part 21.3 of the third actuator 18.3 and to the first pivotable frame 26 to the upper rod mounting positions 33 thereof.

The right and left connector rod 31.4A, 31.4B of the fourth pile connection assembly 16.4 are connected to the lower actuator part 21.4 of the fourth actuator 18.4 and to the first pivotable frame 26 to the upper rod mounting positions 33 thereof.

Each right connector rod 31A is connected to a right side of the associated actuator 18 and each left connector rod 31B is connected to a left side of the associated actuator 18.

The right and left connector rod 31A, 31B of each pair 31 are connected to a same side of the associated pivotable frame 26, 28 and to opposite sides of the associated lower actuator part 21.

Each connector rod 31A, 31B is connected to the associated pivotable frame via an upper hinge. Each connector rod 31A, 31B is connected to the lower part 21 of the associated cylinder actuator 18 via a lower hinge.

Each pair 30 of connector rods 31A, 31B is configured to transfer a tension force and a bending moment from the bridge assembly 12 into the associated pile. The transfer of the tension force and the bending moment takes place via the lower actuator part 21. Because the connector rods 31 are connected to the upper and lower pivotable frames and to the lower parts 21 of the actuators via hinges, the bending moments can only be transferred into the piles in one plane (or about one axis). Due to the hinges, no bending moments about an axis which is parallel to the pivot axis 27, 29 of the respective pivotable frame can be transferred by the connector rods. This allows pivoting of the pivotable frame about the pivot axis.

Each pile connector 22 comprises an insertable part 40 which is configured to be inserted into a pile. Each a pile connector 22 comprises a shoulder 48 configured to rest on the end face of a pile and to transfer the push force to the pile.

Each pile connector comprises one or more grippers 42 configured to grip the upper end of the tubular piles. The grippers 42 can move between an outer, gripping position and an inner, released position as indicated by arrow 44. The grippers 42 may be operated by one or more actuators situated within the insertable part 40. The grippers 42 can be embodied as a lock which fits underneath a ring which is attached to the pile or as separate blocks with teeth which grip into the inside of the pile or systems with similar functionalities.

The grippers 42 may grip the piles from the inside, but may also grip the piles from the outside, or both from the inside and from the outside. In this last embodiment, Hoop stresses are avoided. The grippers 42 can be fixed to the pipes by clamping, gripping (friction), pinning, load carrying ridge(s) etc. or a combination thereof. All of these methods can be internal, external or a combination of internal and external gripping.

The device comprises a suspension organ 46 in the form of an eye which allows suspension of the device from a crane.

Operation—First Embodiment

Figure 4:
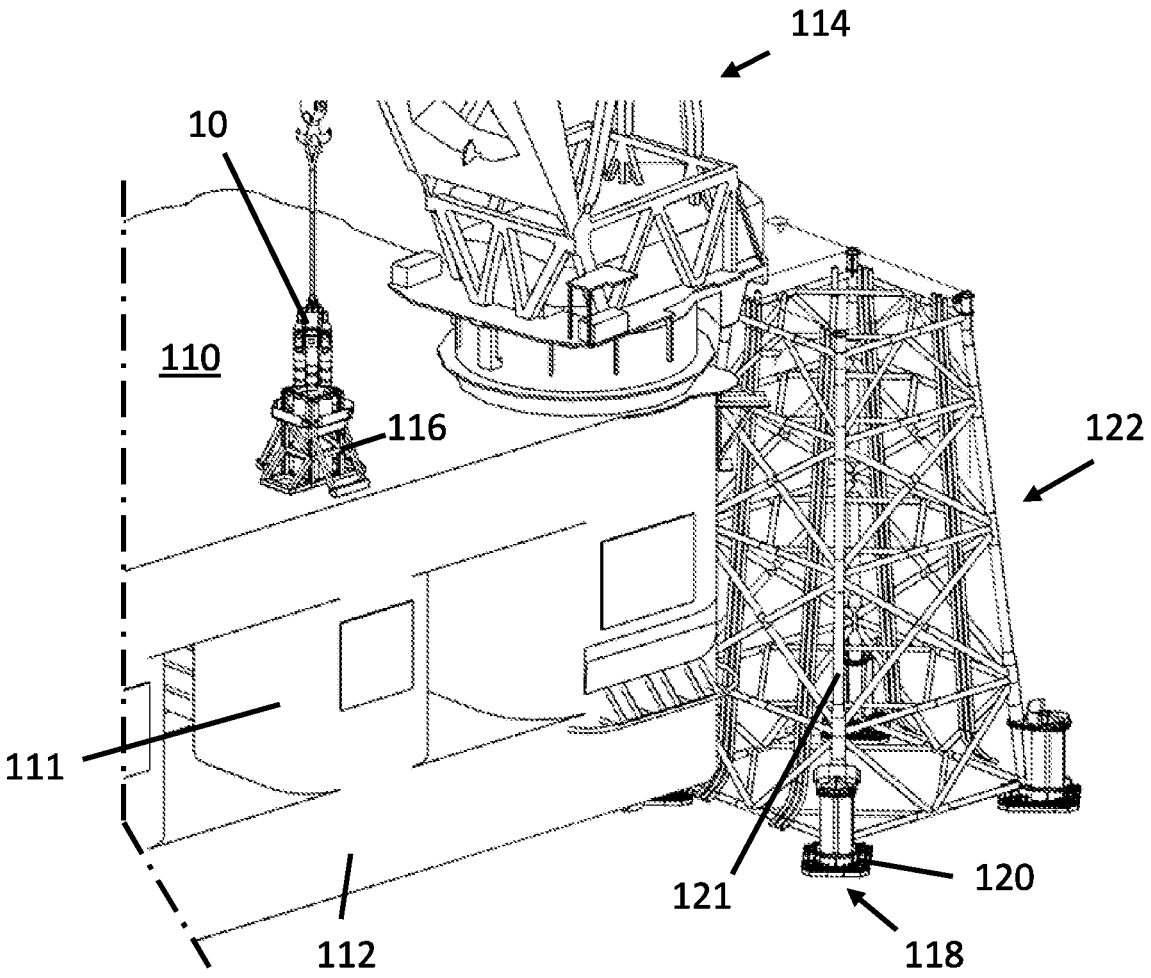
FIG. 4 shows an isometric view of an embodiment of the invention in action.

Turning to FIG. 4, when the device 10 is to be used in an offshore environment, the device 10 may be operated from a vessel 112. The vessel may be a semi-submersible, regular vessel, barge or any other type of vessel.

A pile support frame 116, may be provided on the vessel. The pile support frame is configured to support 4 piles in a pickup configuration. In the pickup configuration, the four piles are positioned parallel to one another at mutual interspacing which corresponds to the interspacing between the connecting locations 14.1-14.4. Preferably the piles ore oriented vertically or substantially vertically. In the embodiment of FIG. 4, the pile support frame 116 is located inside a column 111 of the semi-sub vessel and an upper end of the pile support frame 116 is located at the deck level. In case of a regular hull, the pile support frame 116 may be located inside the hull.

Figure 5:
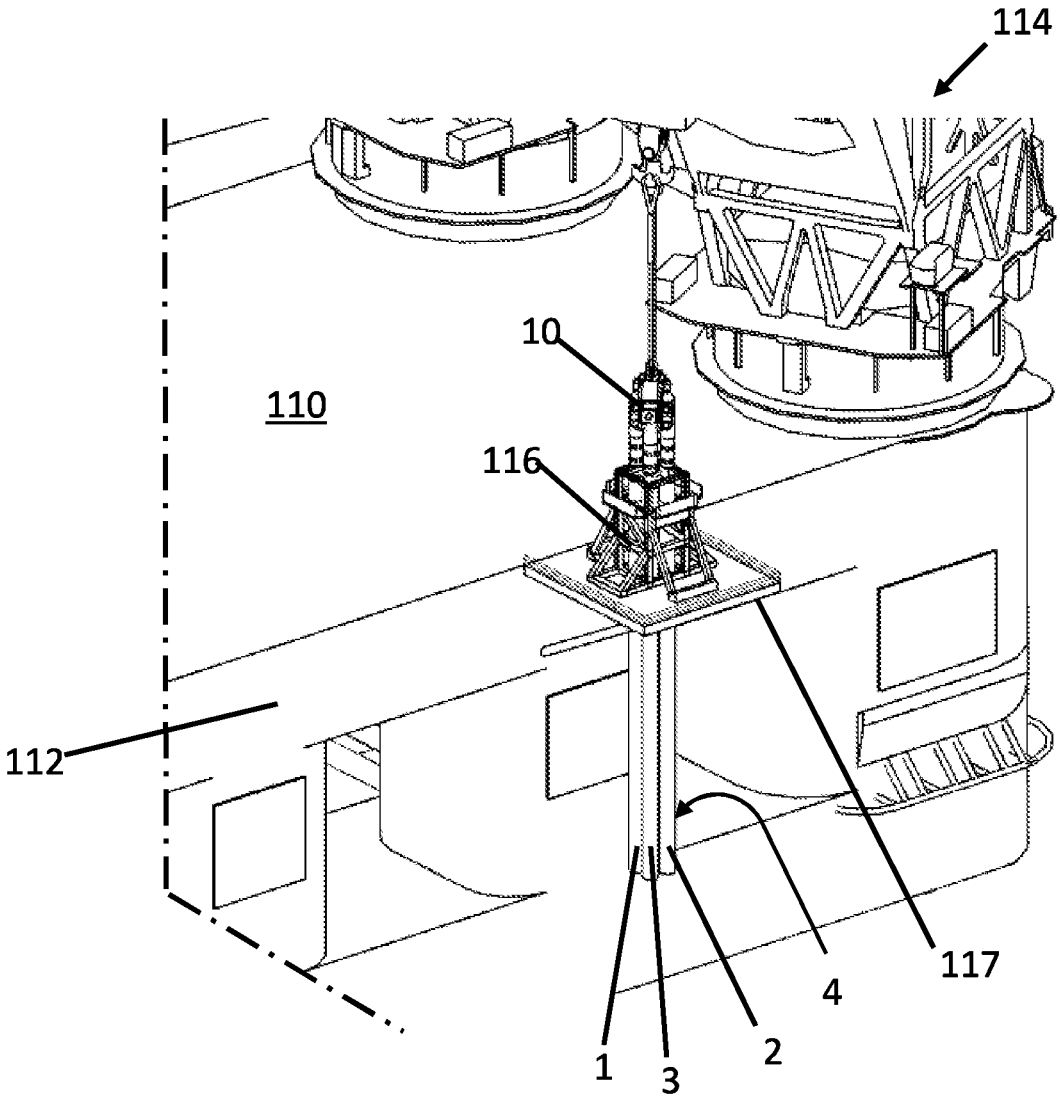
FIG. 5 shows an isometric view of another embodiment of the invention in action.

In the embodiment of FIG. 5, the pile support frame 116 further comprises a platform 117 provided at a side of the vessel 112. The pile support frame 116 cantilevers over the water.

Obviously, other embodiments of the pile support frame 116 are also possible. For instance the pile support frame 116 may be positioned on deck 110 and rise upward from the deck or may be positioned in a moonpool.

In operation, the vessel 112 is positioned at a target location 118, for instance at a base 120 of a leg 121 of a jacket 122. The target location 118 may obviously be any location at which piles need to be driven into the seabed. The device 10 can for instance be used for installing piles into an already installed (part) of a structure (e.g. jacket or template or any other structure) or for so-called "pre-piling", in case the structure or part thereof is not yet in place and eventually is placed over the pre-installed piles.

It is noted that pre-piling can be done with an intermediate template on the sea-floor, the use of a spacer frame could however act as a guidance frame that comes with the piles rather than pre-installing a temporary guidance frame. This would result in a reduction of execution time.

This could, when used for pre-piling, eliminate having a complex pre-pilling template with adjustable inclination systems.

Four piles 1, 2, 3, 4 are positioned in the pile support frame 116. The piles may be tubular. In case of the platform of FIG. 5, the piles may be connected near their upper ends to the pile support frame 116 and be suspended therefrom. The upper end faces of the four piles are flush with respect to one another.

The device 10 may be lifted from the deck 110 of a vessel 112 with a crane 114. The crane 114 lifts the device 10 and subsequently places the device 10 on the four piles 1, 2, 3, 4 as is shown in both FIGS. 4 and 5. Next, the grippers 42 are moved outward and grip the upper ends of the tubular piles, thereby connecting each pile connection assembly 16 to an associated pile. The device 10 is now connected to the four piles.

Figure 6:
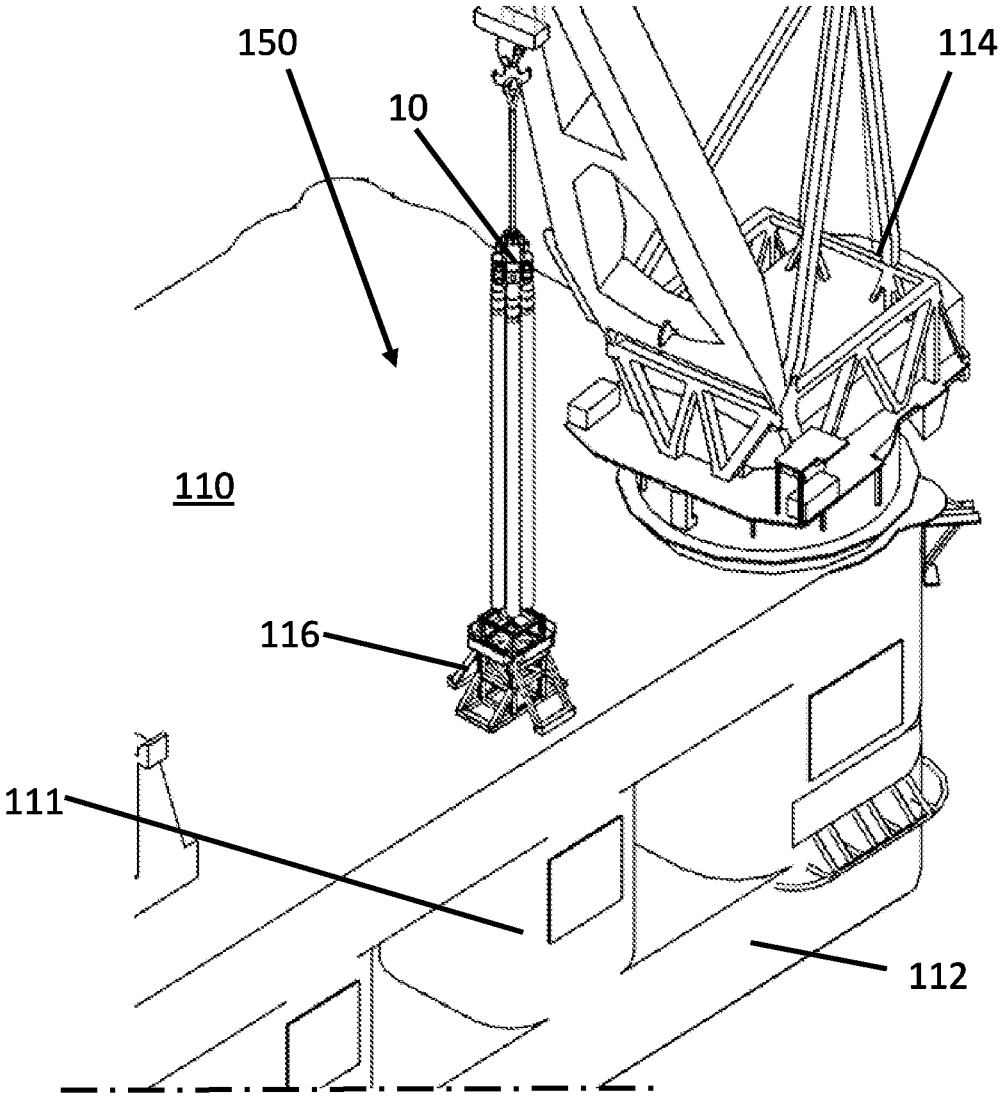
FIG. 6 shows an isometric view of a step in the method according to the invention.

Turning to FIG. 6, the crane 114 subsequently lifts the combination 150 of the device 10 and the four piles 1, 2, 3, 4 from the pile support frame 16 and moves the combination 150 to the target location 118. In order to improve the stability of the combination, temporary wires, braces, brackets, stops or similar device may be provided to prevent the four piles from colliding during the lift, to maintain a required spacing of the lower ends of the piles and to prevent the moving parts of the device 10 from moving.

Optionally, the device 10 can be equipped with a spacer frame to limit relative movement between the piles and between the piles and the device 10. This spacer frame can be hung off underneath the device 10 or be suspended on the piles itself, allowing to install and remove it in one lift or in two separate lifts.

The connection between the spacer frame and the device 10 can for instance be formed by either slings, chains or rigid materials.

Figure 7:
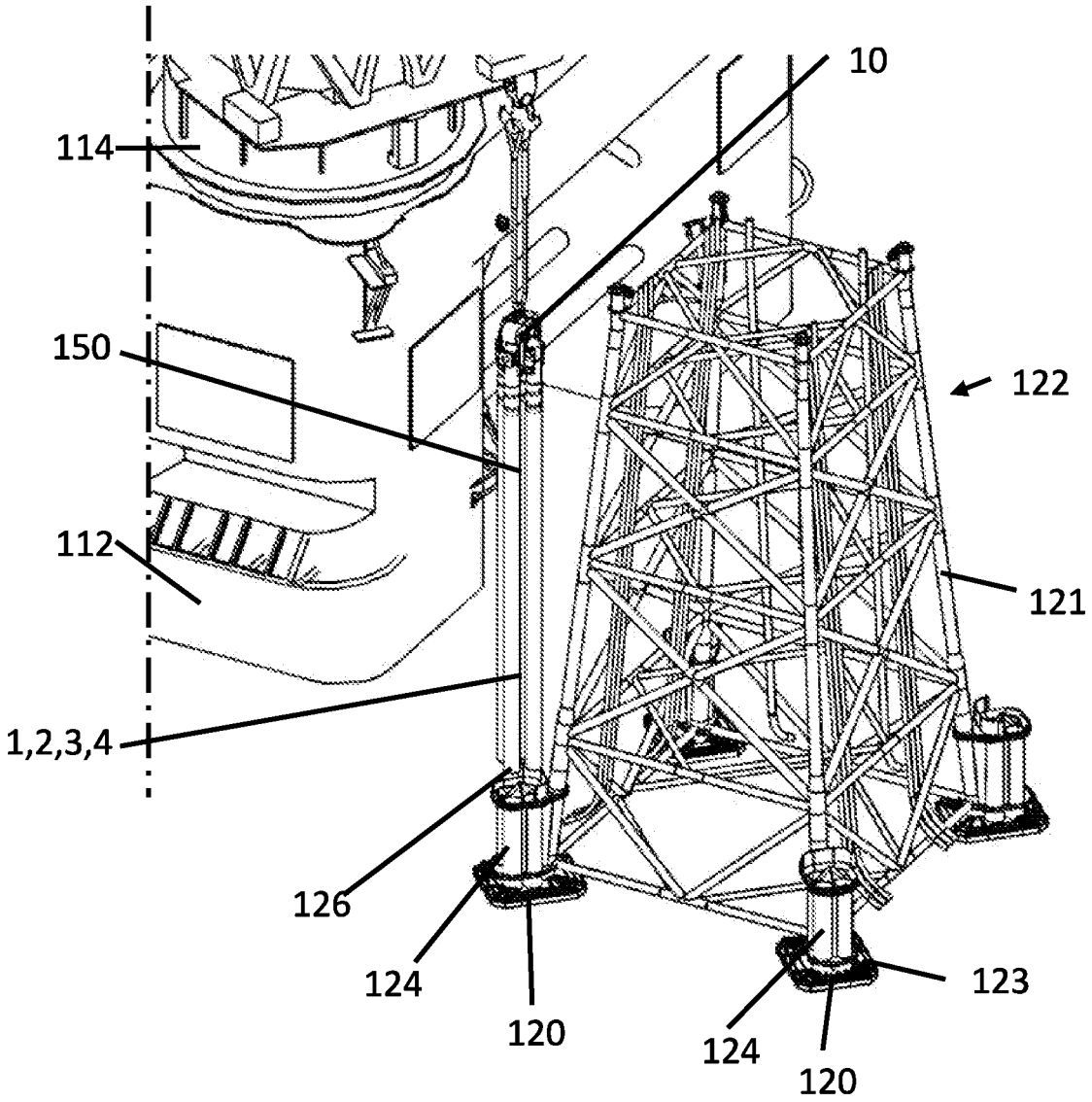
FIG. 7 shows an isometric view of another step in the method according to the invention.

Turning to FIG. 7, the combination 150 is subsequently lowered into the base 120 of a leg of a jacket. The base 120 comprises a base plate 123 and pile sleeves 124 which extend upwardly from the base plate. The four piles 1, 2, 3, 4 are lowered into the four pile sleeves 124. This requires a certain degree of control and accuracy. The bottom ends 126 of the piles are maintained at the required distance from one another by any of the temporary devices discussed above. The pile sleeves 124 may comprise tapered pile guides 125 at their upper ends to facilitate the positioning of the piles into the pile sleeves.

In an embodiment, the initial start-up loads can be transferred to the pile sleeves by providing a rigid connection between the pile connection assemblies of the piles which are under tension and the associated pile sleeves 124. This allows to be able to (partly) omit the use of ballast weight for the start-up weight during the time that limited soil capacity is activated.

It is noted that in an alternative embodiment, the piles may be positioned and lowered into the pile sleeves individually and sequentially, for instance by the crane 114, and prior to the device 10 being positioned on top of the piles 1, 2, 3, 4. Next, the device 10 is then positioned on top of the four piles. In this embodiment, no pile support frame 116 is required.

When the bottom ends of the piles 1, 2, 3, 4 contact the seabed, initially the piles will sink into the seabed under their own weight and the weight of the device 10 over a certain distance, e.g. 50 cm. Additional ballast weight may be provide on top of the device 10 to increase this distance and to improve the overall functioning of the device 10.

Figure 8:
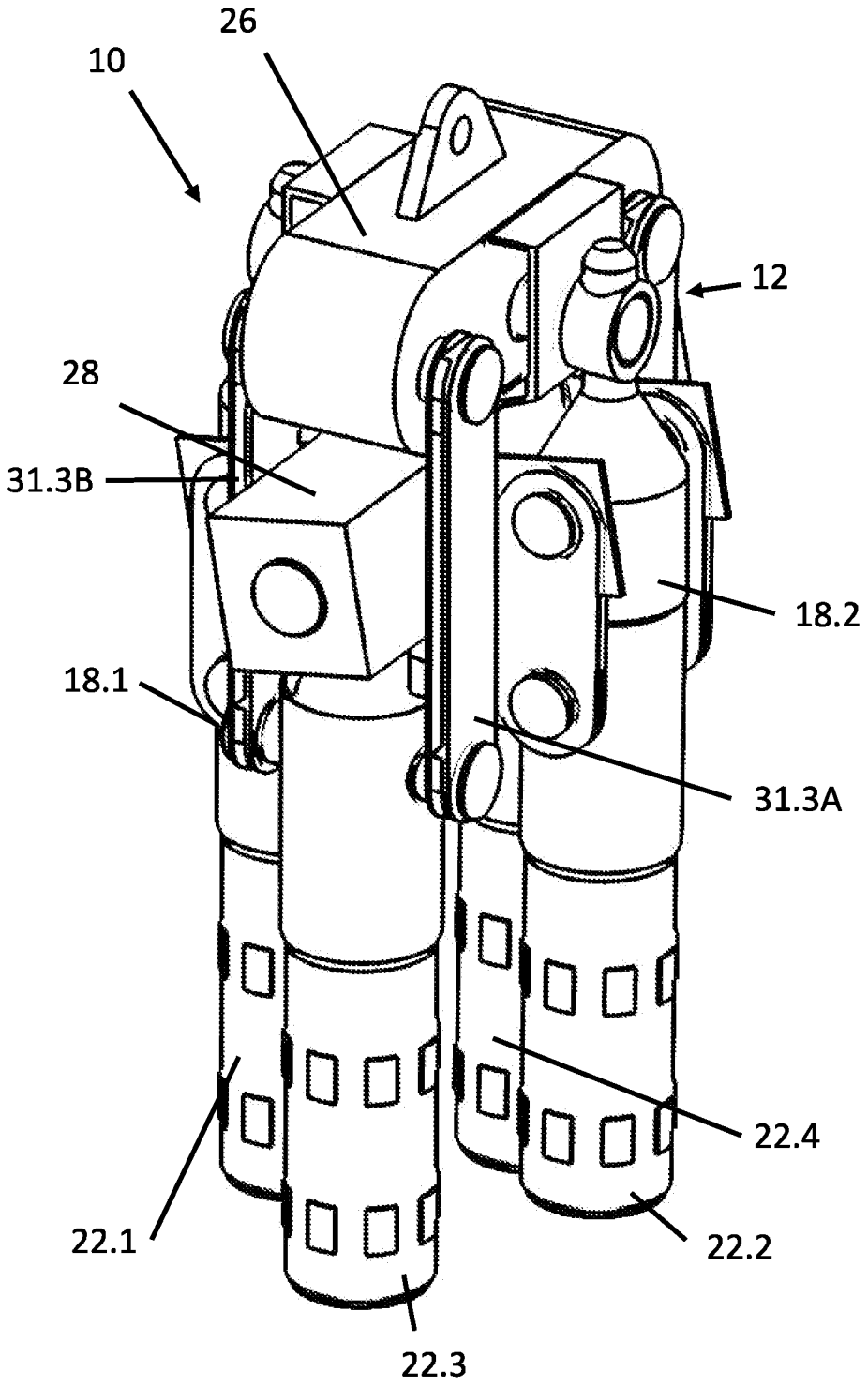
FIG. 8 shows an isometric view of the embodiment of FIG. 1 in action.
Figure 9A:
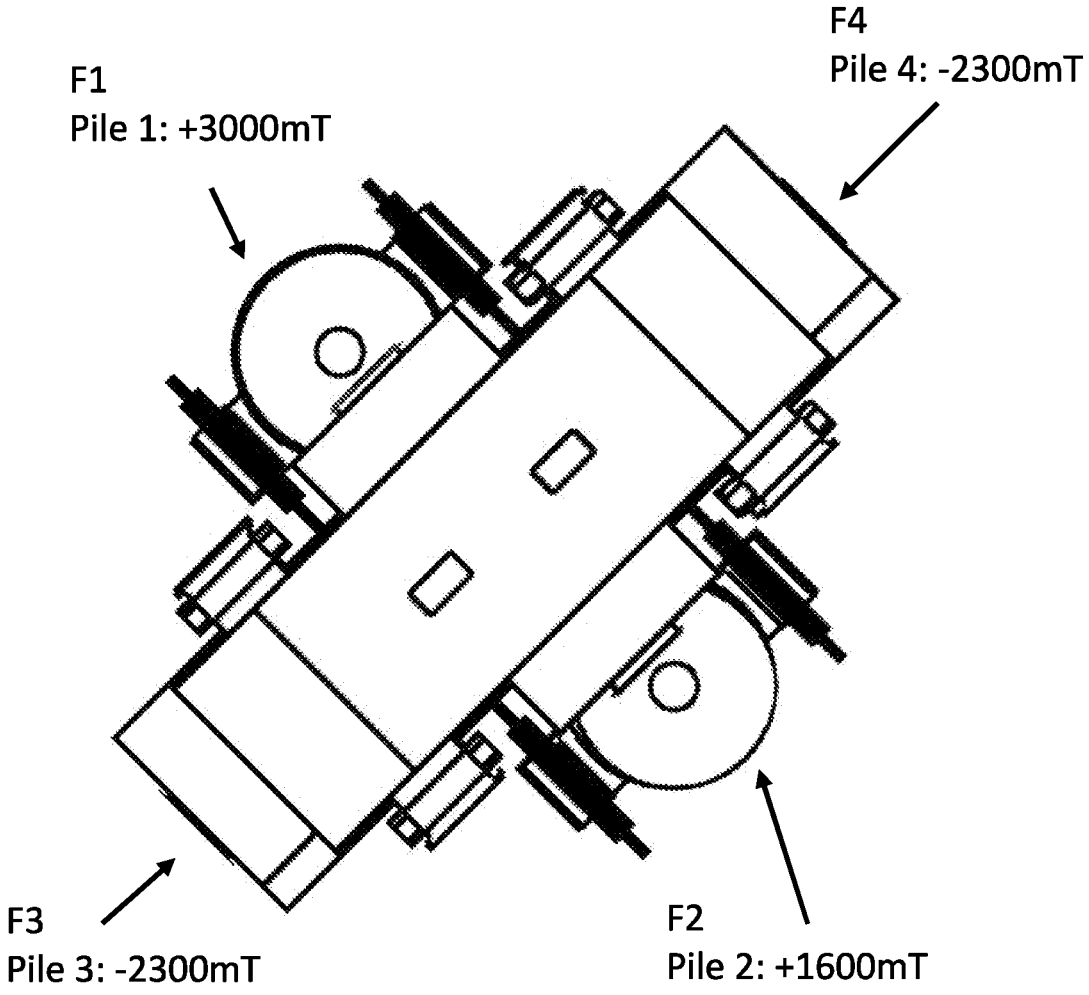
FIG. 9A shows a top view of the embodiment of FIG. 8.
Figure 9B:
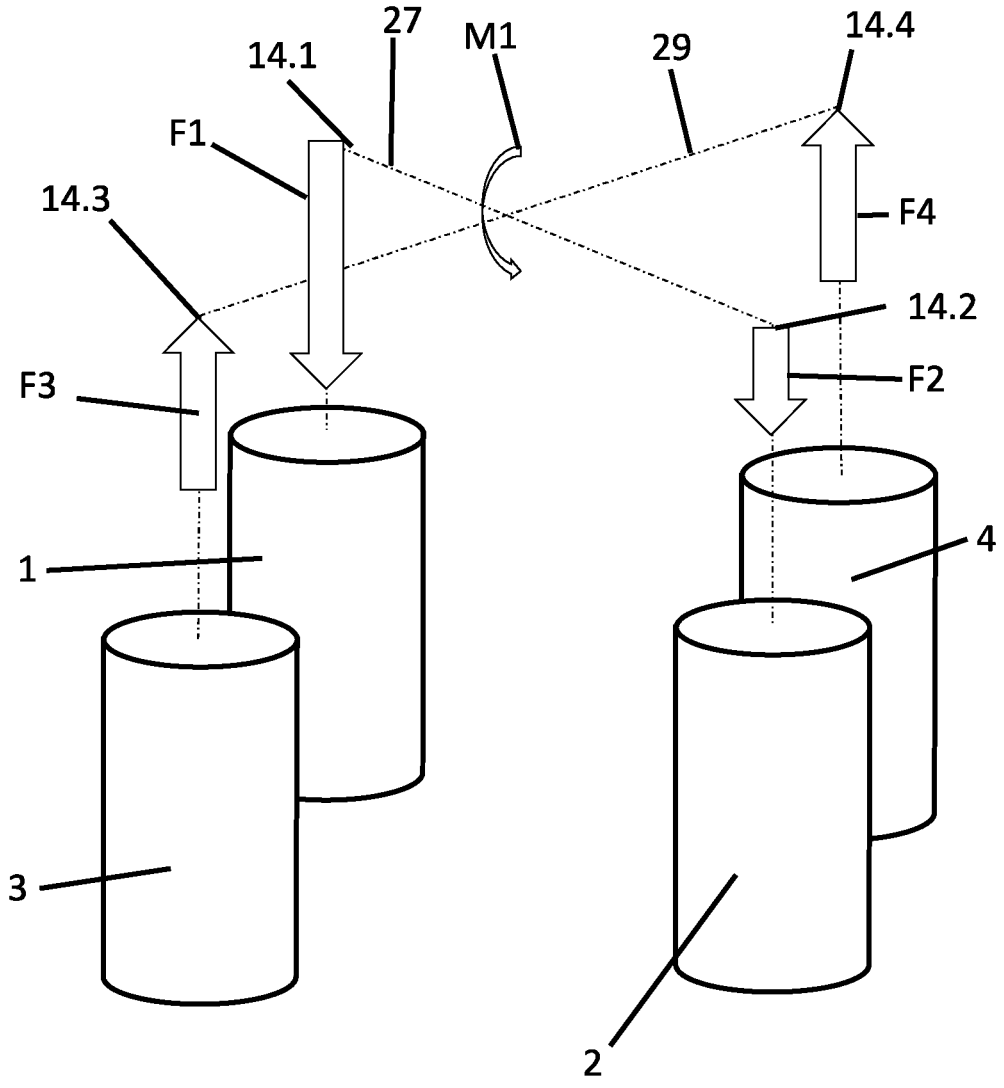
FIG. 9B shows an isometric view showing forces and moments present in the situation of FIGS. 8 and 9.

Turning to FIGS. 8, 9A and 9B, when all piles are inside the pile sleeves and the device 10 is on top of the piles and has gripped the piles (which in top view are in square or diamond configuration), the device 10 can start operating. In a first step, pile 1 is pushed downward. This is done by increasing the hydraulic pressure inside the first actuator 18.1 with the control device. At the same time, the hydraulic pressure inside the second actuator 18.2 is maintained at a lower level.

FIG. 9A shows the resulting forces in the four piles 1, 2, 3 and 4. The force exerted on pile 1 is raised to 3000 mt (for example), the force exerted on pile 2 is maintained at 1600 mT. 3000 mt is an example which is realistic for very dense North Sea sands. Pile 1 will then be pushed downward.

As a result the piles 3 and 4 will be put under tension, each at −2300 mT. The minus indicates that the force is a tension force. The four forces result in a balance of forces, but in an imbalance of moments on the bridge assembly 12 and in particular on the first pivotable frame 26. It is noted that during the extension of the first actuator, the first pivotable frame 26 is held stationary.

Turning to FIG. 9B, the same forces F1, F2, F3 and F4 are shown in an isometric drawing. When pile 1 is pushed downward, these four forces will result in an imbalance of bending moments about axis 29. In order to restore equilibrium the piles 3 and 4 need to exert a bending moment M1 (=1400*d) about axis 29 on the upper pivotable frame 26.

Turning to FIGS. 8, 9A, 9B, 13 and 14, the tension forces and the bending moment are exerted from the piles 3, 4 on the upper pivotable frame 26 via the connector rods 31.3A, 31.3B, 31.4A and 31.4B which extend between the lower actuator parts 21.3, 21.4 and the upper pivotable frame 26. Because action=−reaction, the force of pile 1 on the first pivotable frame will be 3000 mT and the force exerted by pile 2 will be 1600 mT. In order to provide equilibrium, the tension force in connector rod 31.3B (indicated in FIG. 14) of connection assembly 16.3 will be greater than the tension force in connector rod 31.3A of connection assembly 16.3.

As can be seen in FIG. 8, during the insertion stroke of pile 1, the first pivotable frame 26 remains stationary while the second pivotable frame 28 pivots about its pivot axis 29 and becomes tilted. This is caused by the connector rods 31 which extend between the lower actuator part 21 and the second pivotable frame 28. These connector rods pull the second pivotable frame 28 down on the side of the first pile 1.

Figure 14:
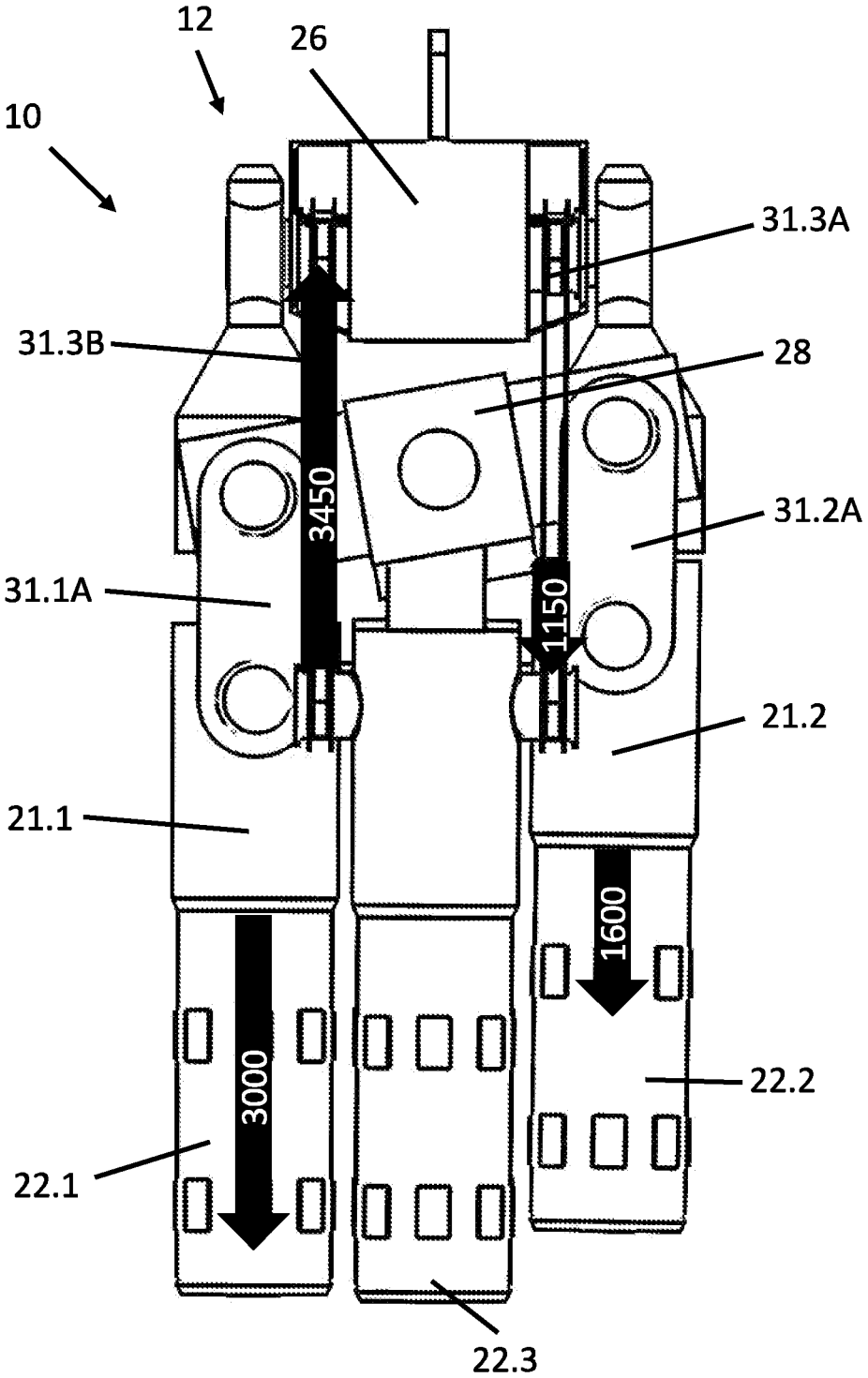
Figure 15:
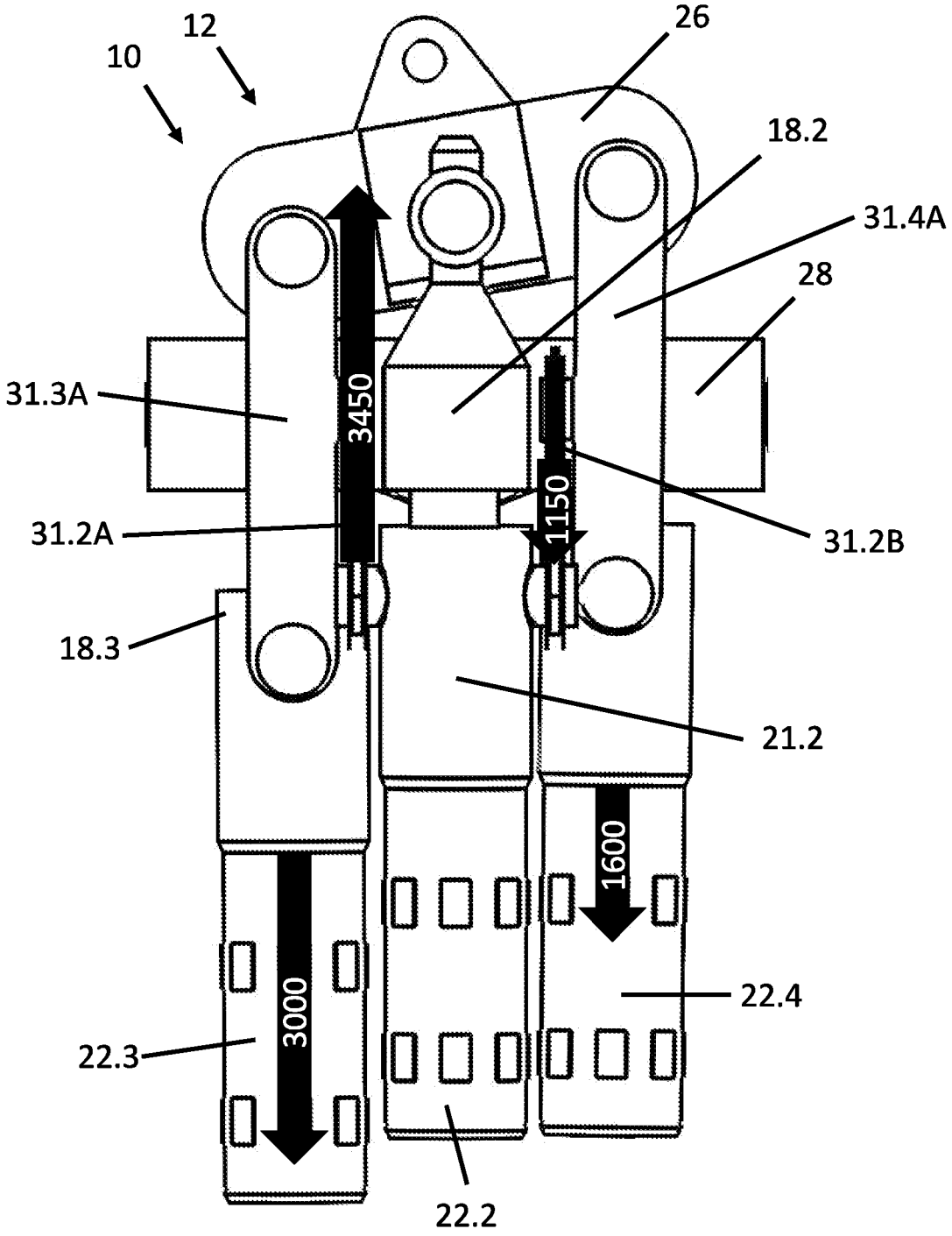
Figure 16:
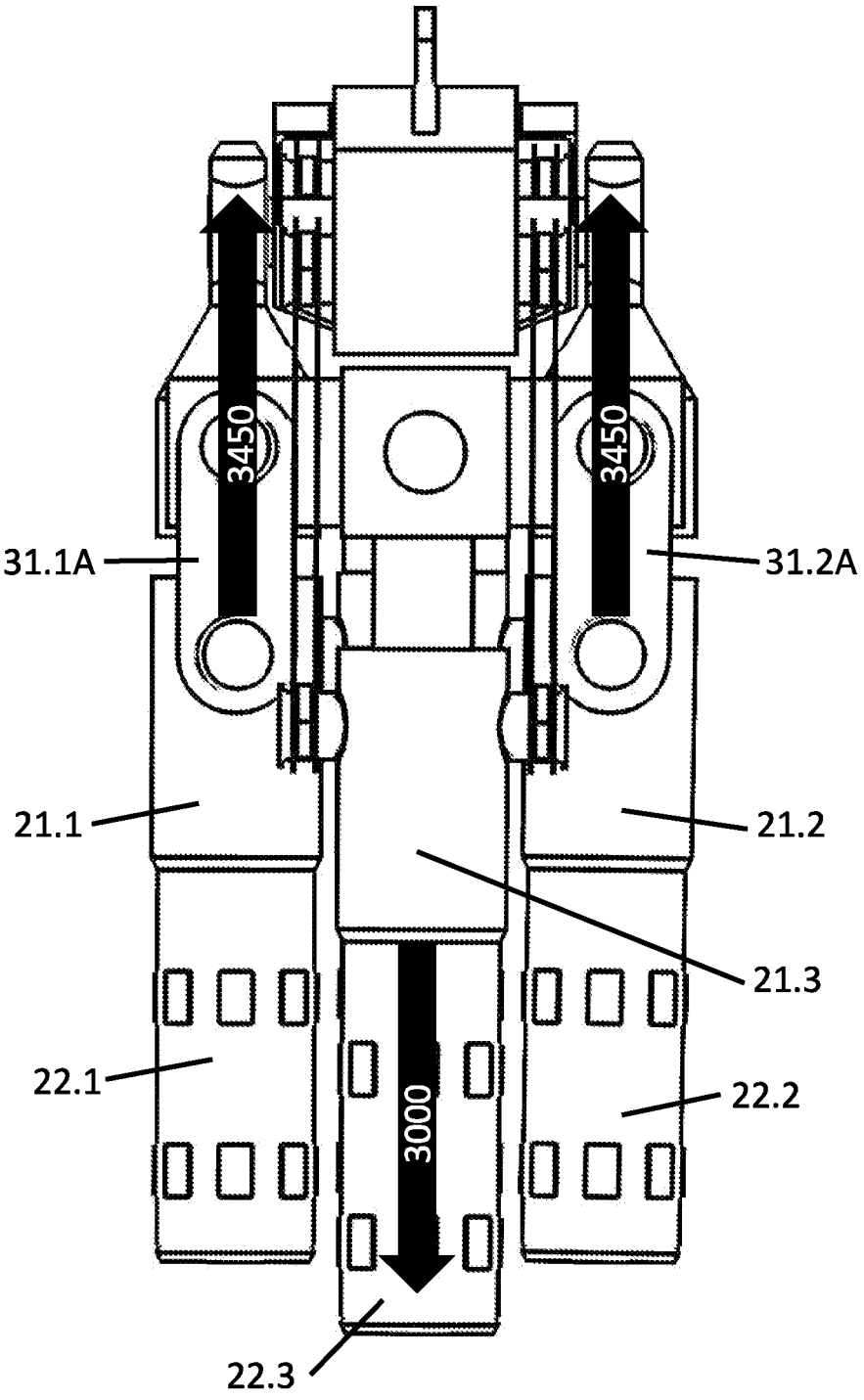

Returning to FIGS. 13 and 14, the occurring forces are shown during the insertion of pile 1. The combined tension force occurring in the two right connector rods 31.3A, 31.4A which are connected to respectively the lower actuator part 21.3 and the lower actuator part 21.4 is shown in FIG. 14 as 1150 mT, i.e. 625 mT for the right connector rod 31.3A and 625 mT for the right connector rod 31.4A. The combined tension force occurring in the two left connector rods 31.3B, 31.4B which are connected to respectively the lower actuator part 21.3 and the lower actuator part 21.4 is shown in FIG. 14 as 3450 mT, i.e. 1725 mT for the left connector rod 31.3B and 625 mT for the left connector rod 31.46. Together, these forces transfer a tension force and a bending moment into piles 3 and 4.

Figure 10:
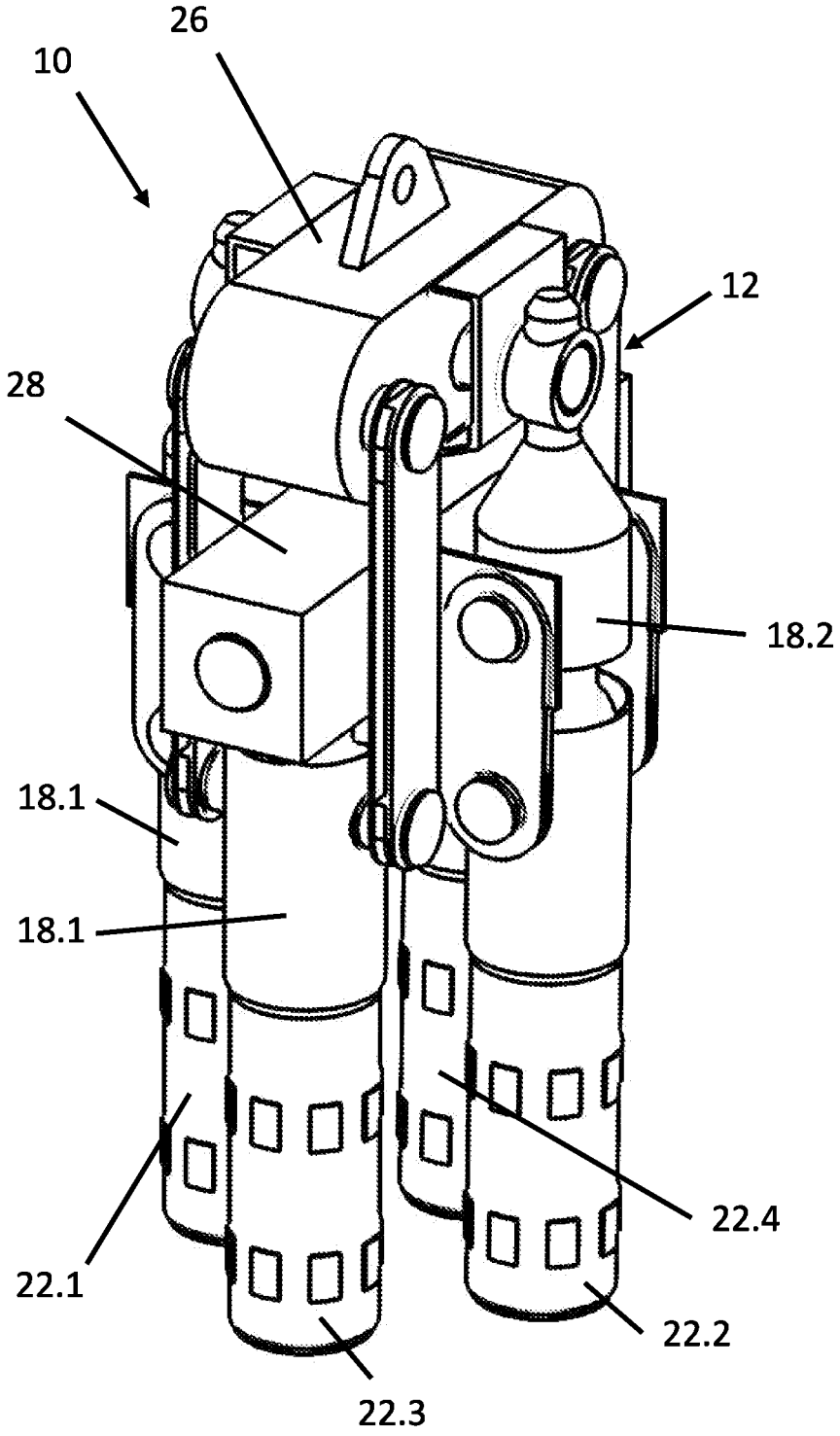
FIG. 10 shows an isometric view of the embodiment of FIG. 1 in action.
Figure 11:
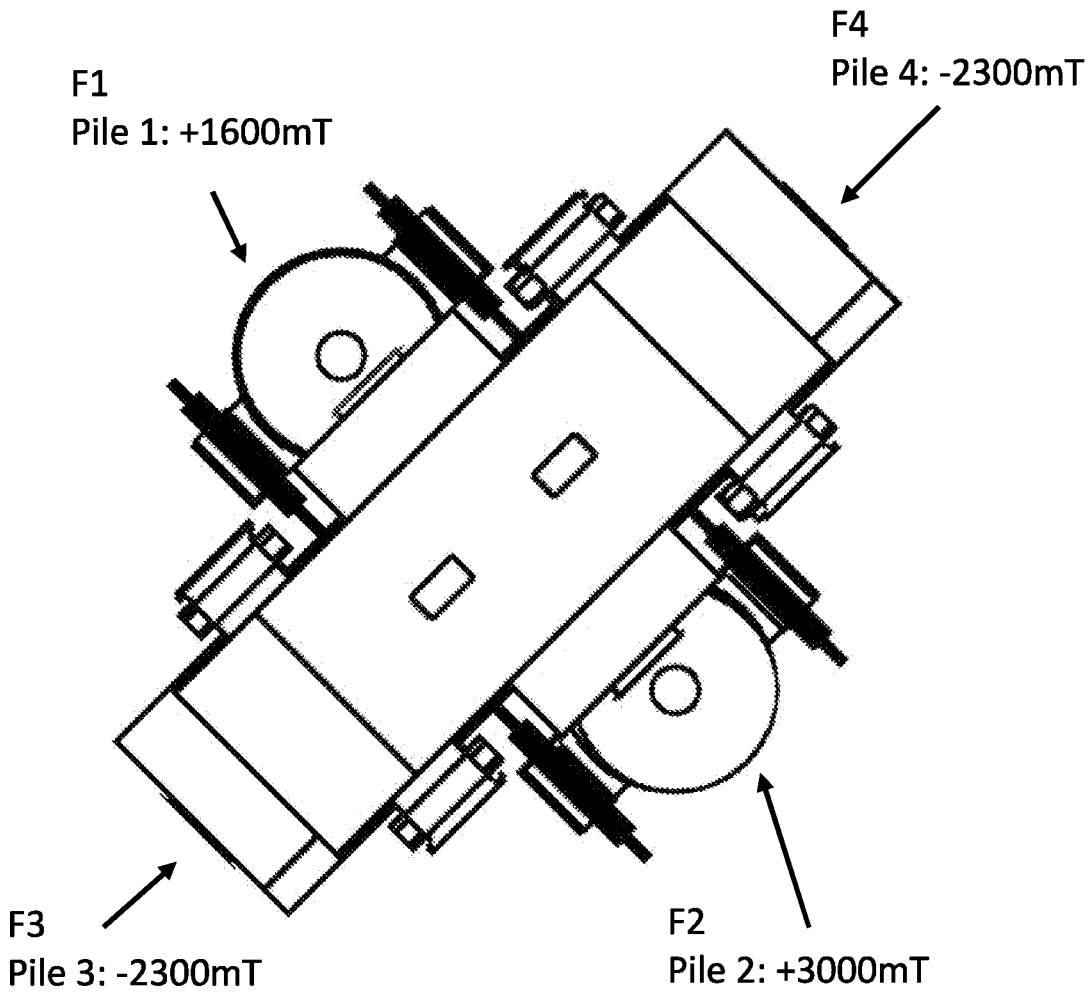
FIG. 11 shows a top view of the situation shown in FIG. 10.

Turning to FIGS. 10 and 11, when pile 1 has been inserted over the distance of the stroke of actuator 18.1 into the ground or seabed, the same process is carried out for the opposite, second pile 2. The hydraulic pressure in the second actuator 18.2 is raised and the hydraulic pressure in the first actuator 18.1 is lowered until F1=1600 mT and F2=3000 mT. F3=F4=−2300 mT. As a result, the second actuator 18.2 makes an extension stroke and pushes pile 2 into the ground or seabed. Pile 1 remains stationary during this time. The second pivotable frame 28 tilts back to a horizontal orientation. The piles 3, 4 are again put under tension while at the same time a moment M2 is imparted onto piles 3 and 4. M2 is opposite to M1.

Figure 17:
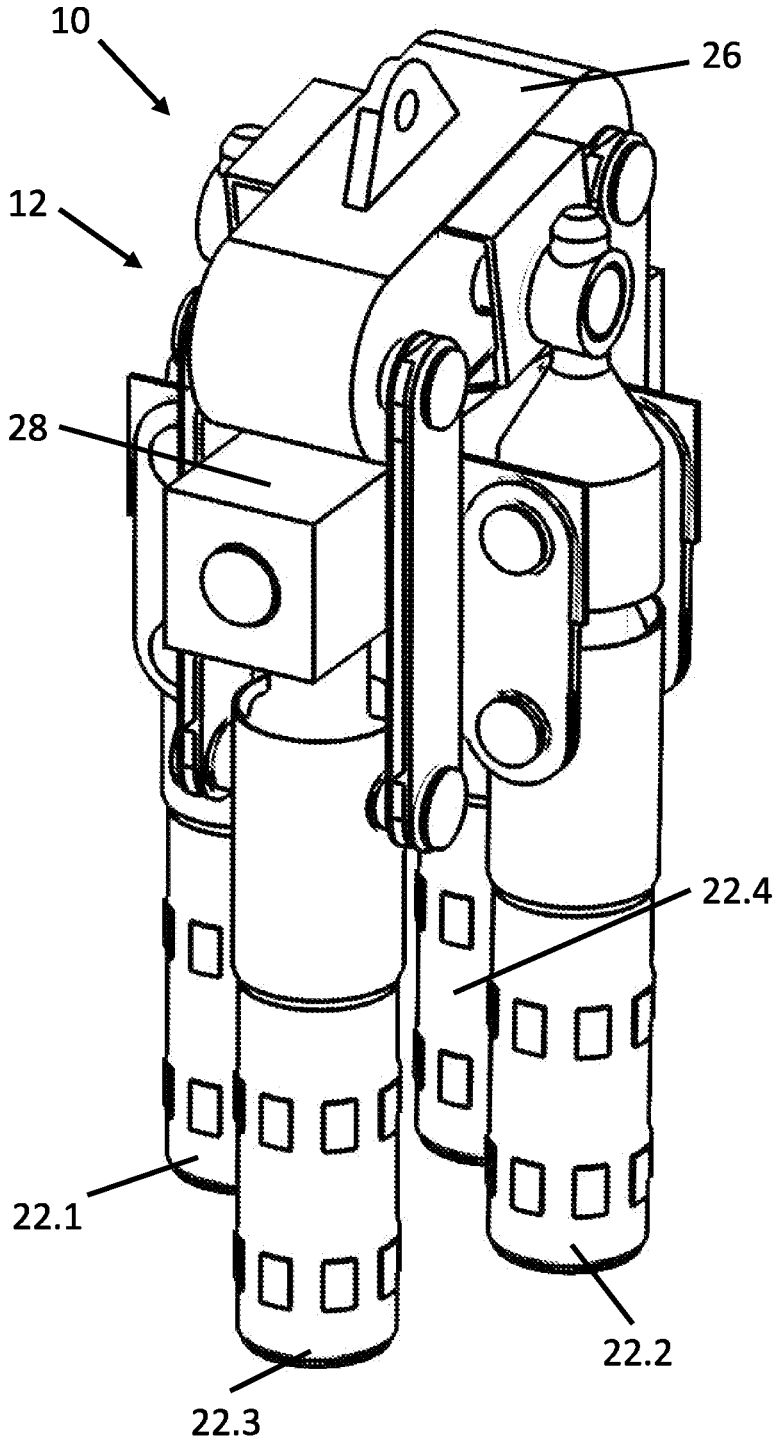
FIG. 17 shows another isometric view of the device in action.
Figure 18:
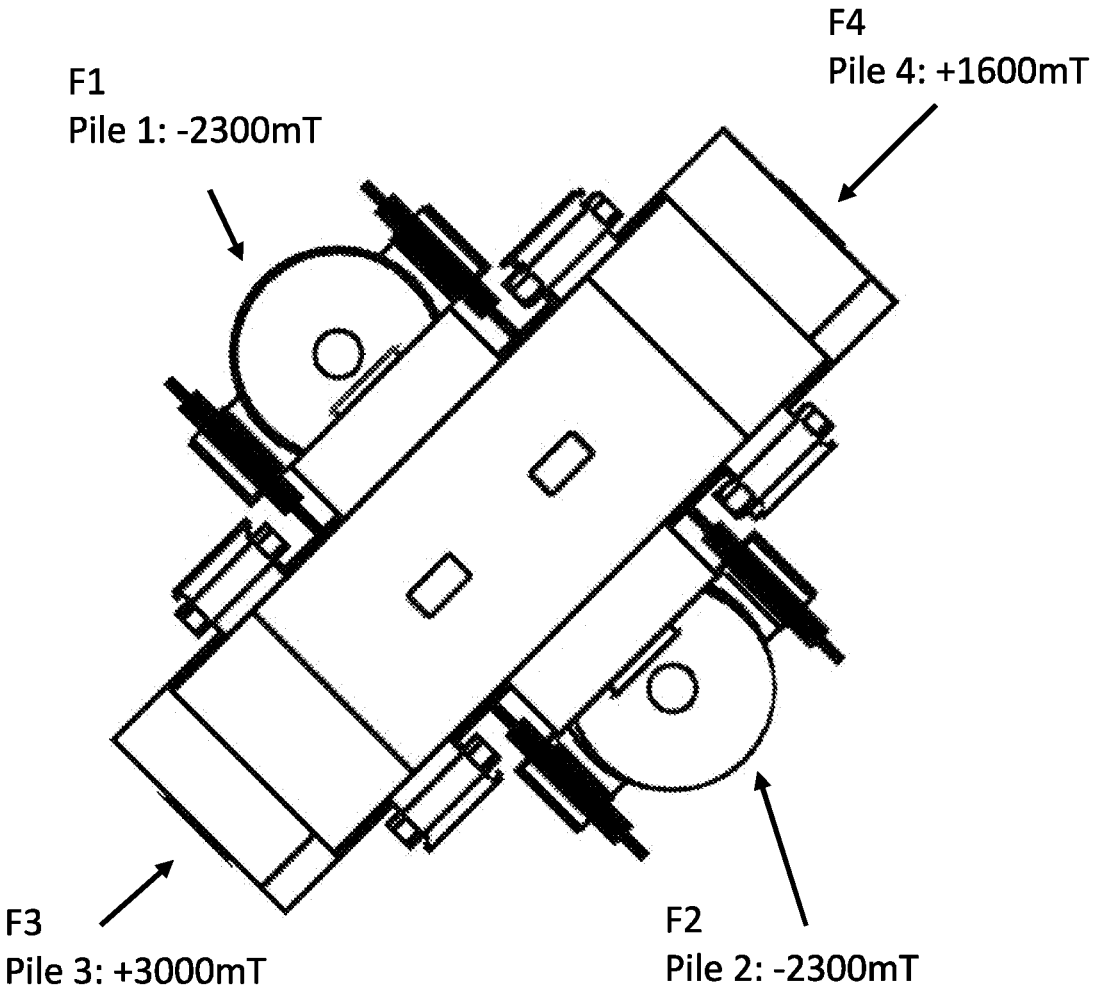
FIG. 18 shows a top view associated with FIG. 17.

Turning to FIGS. 17 and 18, the same process is repeated for pile 3. Actuator 18.3 is extended and as a result, pile 3 is inserted into the ground or seabed over a distance. Now, the second pivotable frame 28 remains stationary while the first pivotable frame 26 pivots about its pivot axis 27. F3 is now +3000 mT, F1 and F2 are −2300 mT and F4 is +1600 mT.

Figure 19:
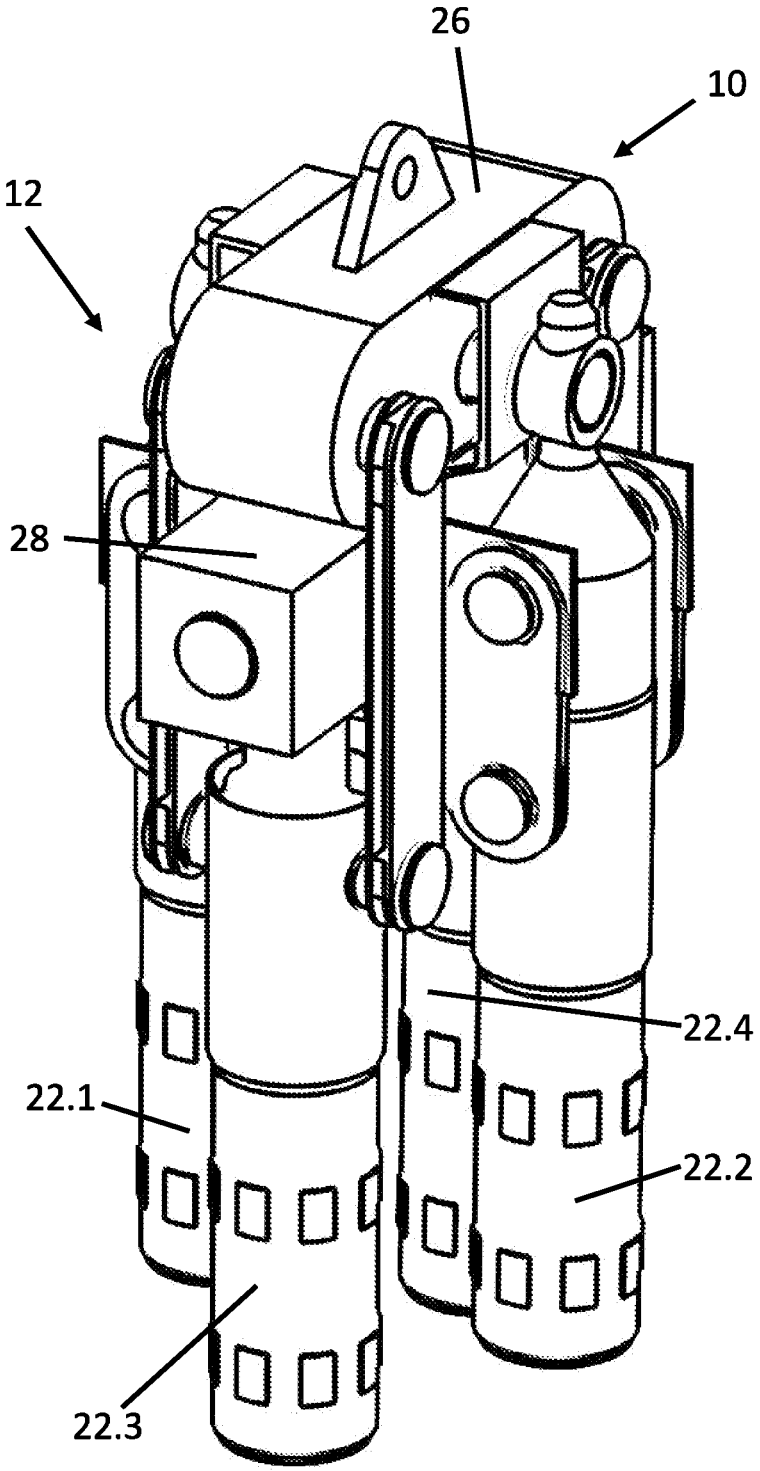
FIG. 19 shows another isometric view of the embodiment of FIG. 1 in action.
Figure 20:
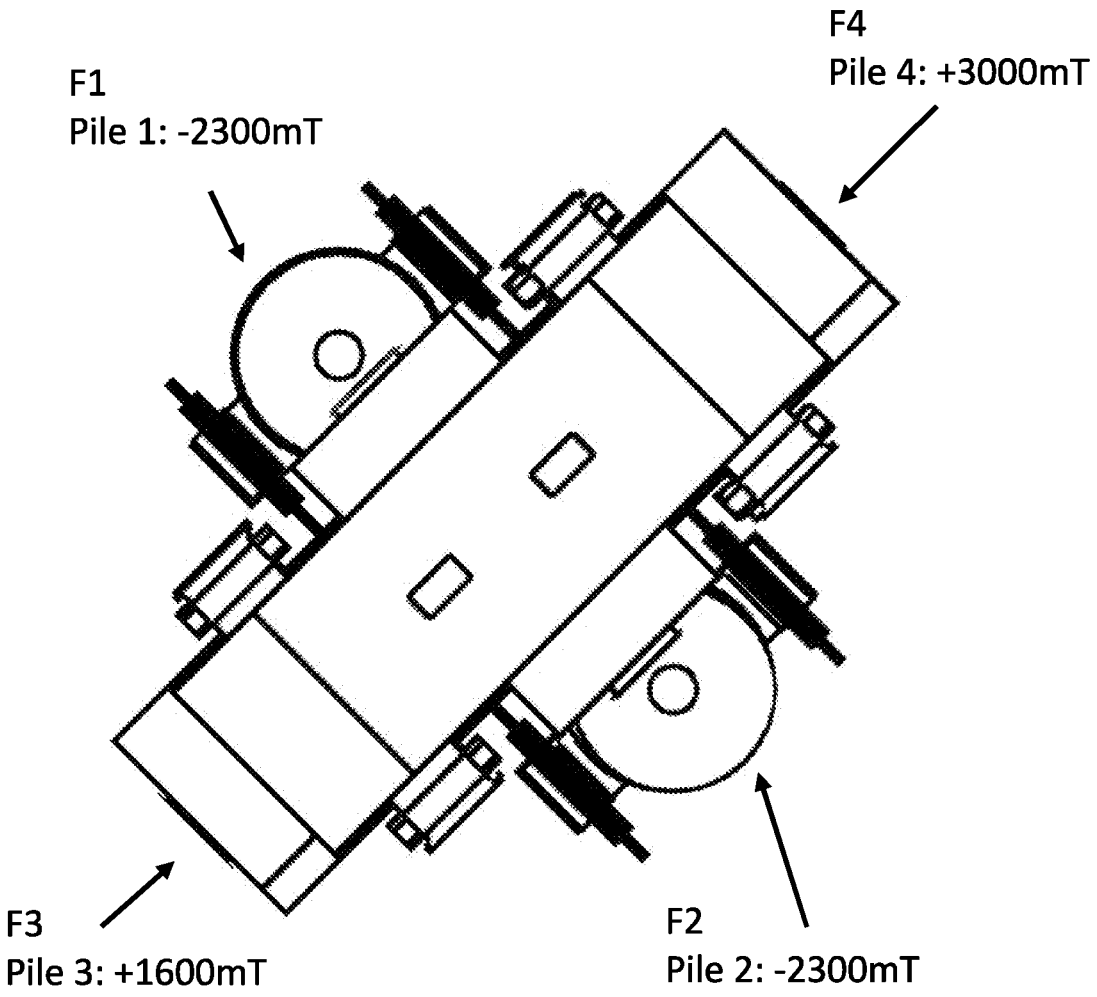
FIG. 20 shows a top view associated with FIG. 10.

Turning to FIGS. 19 and 20, the same process is repeated for pile 4. Pile 4 is inserted over a distance into the ground by extending actuator 18.4. The first pivotable frame 26 pivots back to its horizontal orientation.

Figure 21A:
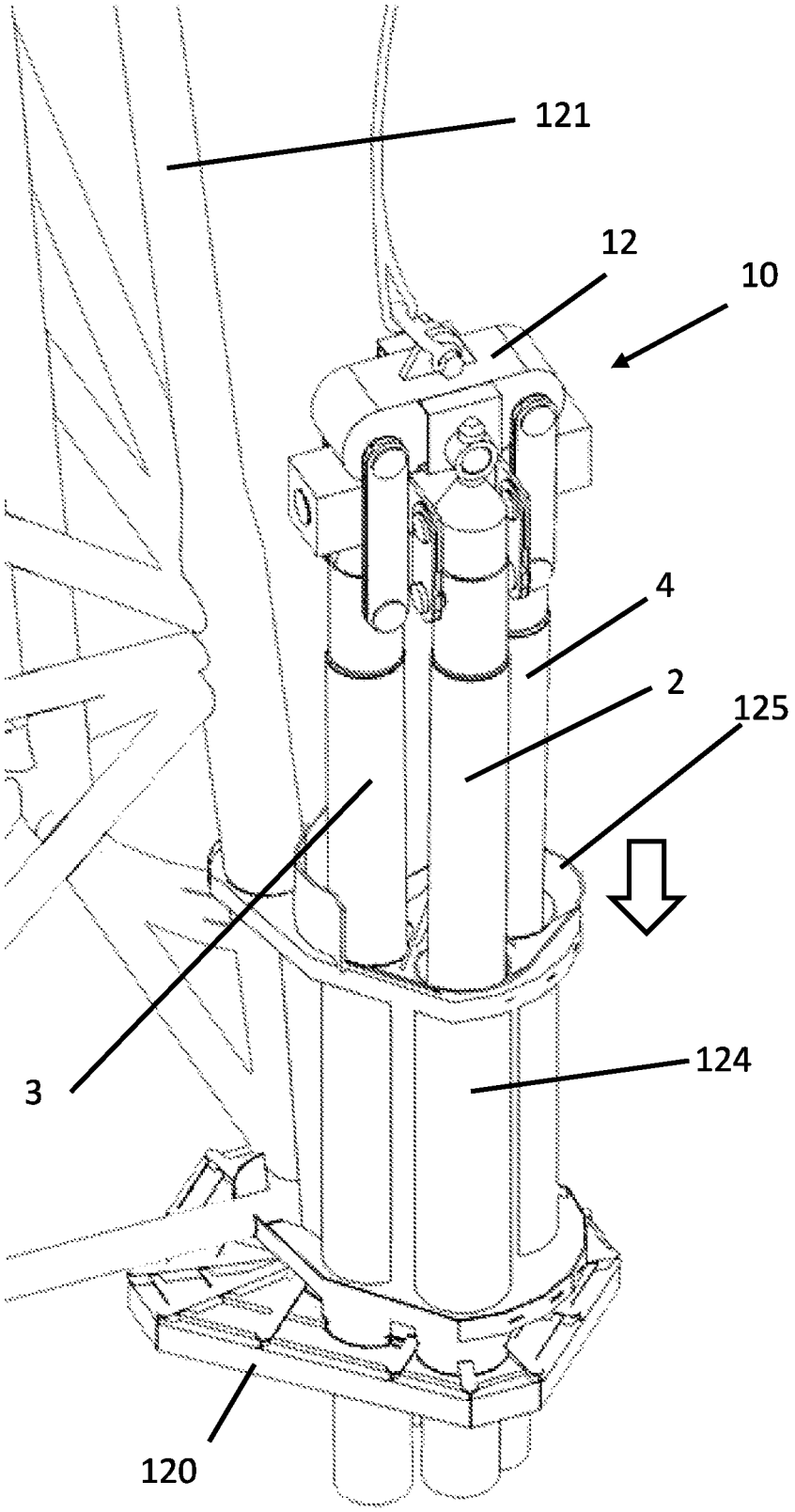
FIG. 21A shows the device according to the invention in action.

Turning to FIG. 21A, when all four piles have been inserted into the ground or seabed over a distance once, a full cycle has been completed. Each cycle comprises the following steps in the sequence as indicated:

pushing the first pile over a distance into the ground or seabed, pushing the second pile which is opposite to the first pile over a distance into the ground or seabed, pushing the third pile over a distance into the ground or seabed, pushing the fourth pile which is opposite to the third pile over a distance into the ground or seabed.

All four piles are now (assuming that everything went well) inserted into the ground or seabed over a same distance, and the method can continue with inserting pile 1 over a next distance.

A number of cycles are carried out until all four piles are inserted into the ground or seabed over the required depth. The device 10 moves downward together with the piles. Alternately each one of the four piles 1, 2, 3, 4 is pushed over a distance into the ground or seabed by extending the actuator 18 which is associated with said pile. During the extension the control device 100 regulates the hydraulic pressures inside the actuator which extends and inside the opposite actuator in order to let the pile which is pushed into the ground or seabed receive a greater force than the opposite pile of the square or diamond configuration. The exerted push force is transferred from the respective actuator into the bridge assembly 12 and transferred at least partially from the bridge assembly as a tension force and a bending moment into the two adjoining piles via the two adjoining pile connection assemblies.

During the extension of an actuator 18, the pivotable frame 26, 28 which is connected to the upper part 20 of said actuator is maintained stationary and the other pivotable frame pivots. The actuator 18 which extends transfers an exerted push force into the bridge assembly and wherein said push force is transferred at least partially from the bridge assembly as a tension force and a bending moment into the two adjoining piles via the two adjoining pile connection assemblies.

Optionally, the device 10 can be equipped with a gripper or a lock system at the bottom of the lower bridge.

Figure 21B:
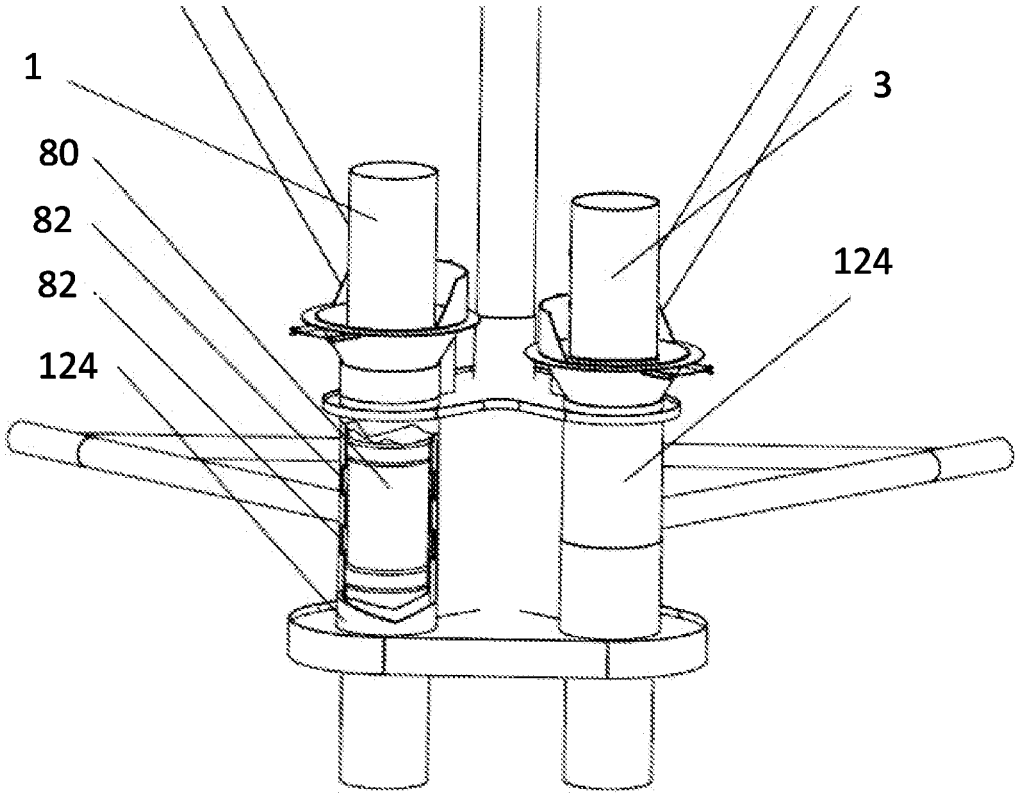
FIG. 21B shows an isometric view of a swaging tool.
Figure 22:
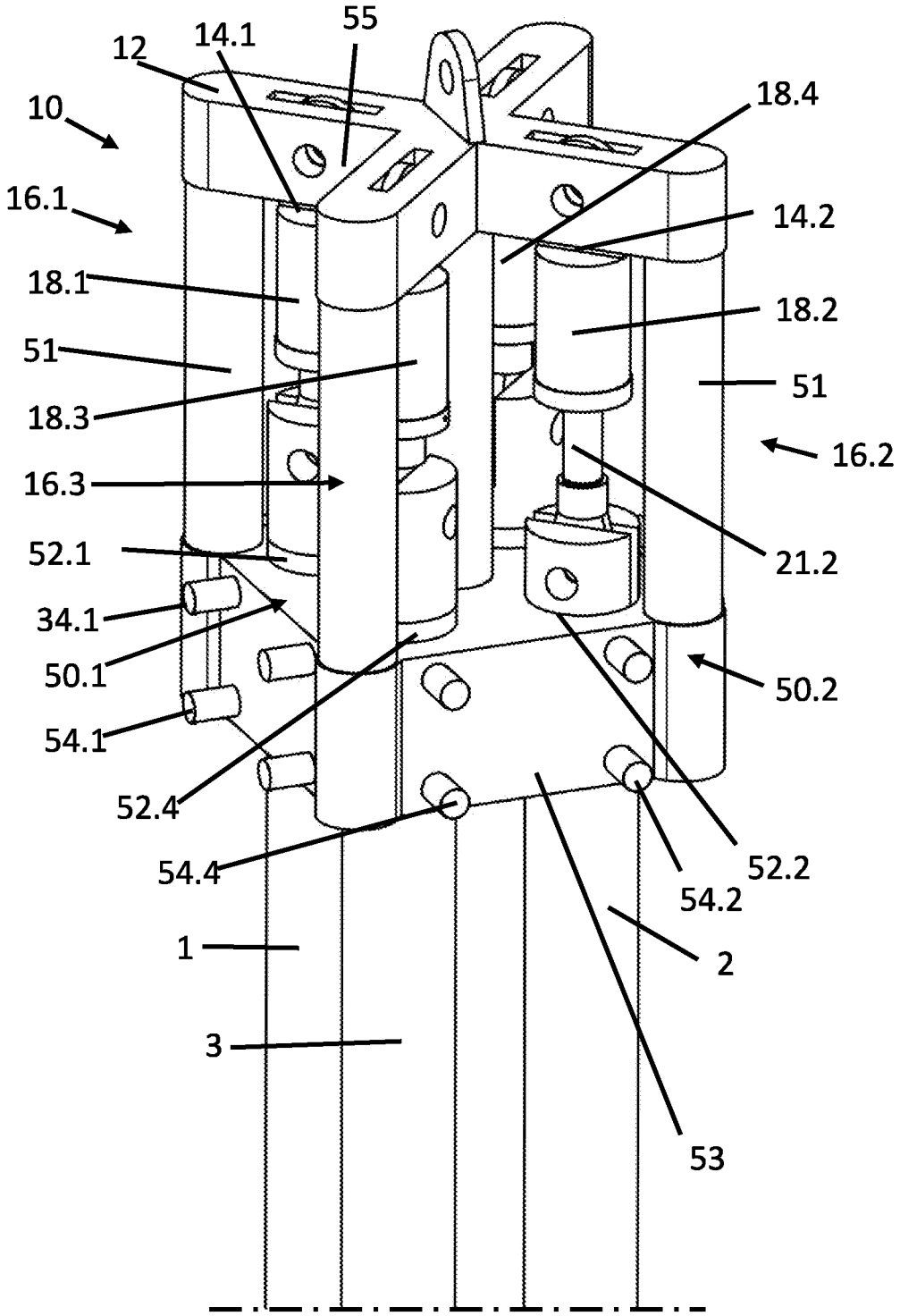
FIG. 22 shows an isometric view of another embodiment of the invention.
Figure 23:
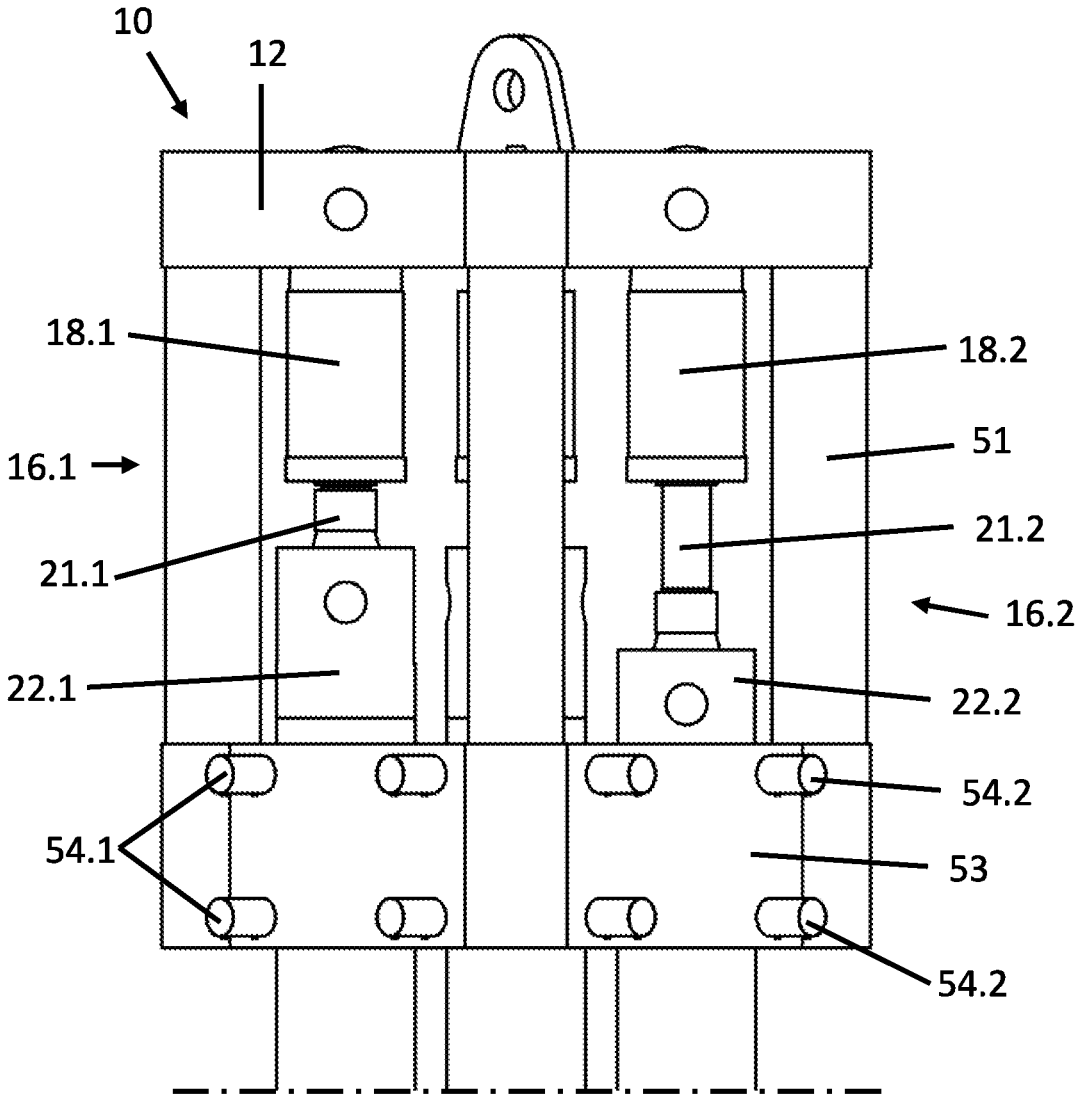
FIG. 23 shows a side view of the embodiment of FIG. 22.
Figure 24:
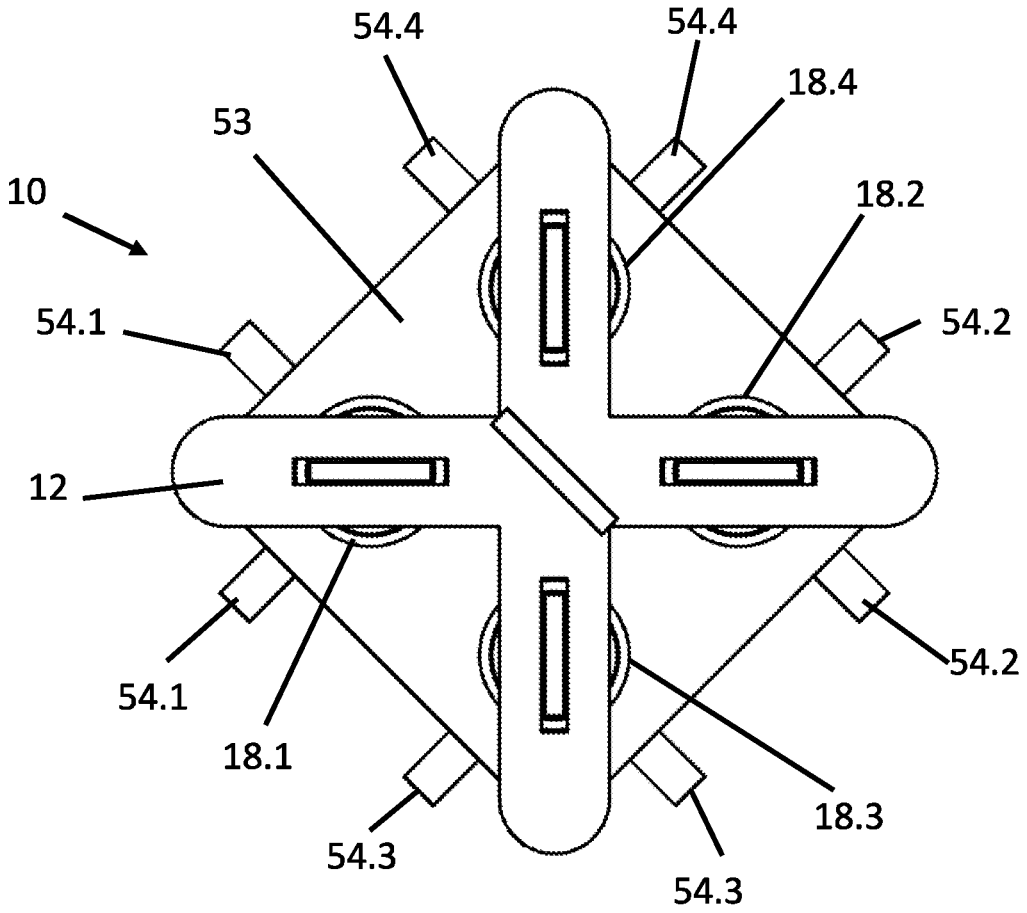
FIG. 24 shows a top view of the embodiment of FIGS. 22-23.

With reference to FIG. 21B, the device 10 can be further equipped with one or more swaging tools 80. The swaging tool 80 can be integrated with the insertable part 40 or can be provided as an add-on. This swaging tool itself is known from the prior art and allows to plastically deform the pile in radial direction by applying a pressure. This deformed shape than fits into one or more internal cavities 82 in the pile sleeve to form a mechanical connection. The cavity may extend circumferentially around the central passage. This removes the need to grout the pile to the sleeve.

The gripper or lock system can engage with the pile sleeve 124 ensuring a connection between the two. If all the actuators 18 are then extended the device 10 can pull up the pile sleeve and tilt the jacket. This can be used on the lowest corner of the jacket to adjust the jacket level. Afterwards the swaging tool can be used to mechanically connect the pile sleeves with the pile to ensure that the jacket stays level.

The proposed system can be used for installing piles into an already (part) of a structure (e.g. jacket or template or any other structure) or for the pre-piling where the structure is not yet in place and eventually is placed over the pre-installed piles.

Pre-piling can be done with an intermediate template on the sea-floor, the use of a spacer frame could however act as a guidance frame that comes with the piles rather than pre-installing a temporary guidance frame. This results in a reduction of execution time.

Measurements

When driving piles it is generally advantageous to monitor the process with measurement equipment. There are several reasons for this.

One reason is that it is a requirement for the German authorities to have an indication of capacity of the pile after installation. In piles which are hammered, normally additional measurement systems have to be placed on the pile after the pile has been hammered into the ground. This is due to the fact that the blows are so hard that electronic equipment becomes damaged. An advantage of the device 10 is that it, because it requires no hammering, electronic equipment can be placed on the device 10 and the piles 1, 2, 3, and 4. This enables a constant read-out of the pile capacity through the pressures in the cylinders, therefore no additional measurements are required.

By measuring the depth of the piles independently, the top of the piles can be placed level or within a desired inclination even if the piles are at an offset of the desired inclination.

This could, when used for pre-piling, eliminate having a complex pre-pilling template with adjustable inclination systems.

Second Embodiment—Sliding Assembly

Turning to FIGS. 22-25, a second embodiment is shown. In this embodiment, each pile connection assembly 16 (16.1, 16.2, 16.3, 16.4) comprises a sliding assembly 50 (50.1, 50.2, 50.3, 50.4) which is rigidly connected to the bridge assembly 12.

This embodiment does not have any pivotable frames. The actuators 18 are connected with their upper parts 22 the bridge assembly 12.

In this embodiment, the bridge assembly 12 comprises an upper bridge part 55. In this embodiment, the pile connection assemblies 16 are rigidly connected together via a base frame 53. The base frame is rigidly connected to the upper bridge part 55 via four columns 51. The base frame 53 is rigidly connected to each of the four columns 51, and the columns are rigidly connected to the bridge assembly 12. The overall construction has the configuration of a box frame. The connecting locations 14 are at the upper bridge part 55. The base frame 53 defines four sleeves 52.

Figure 25:
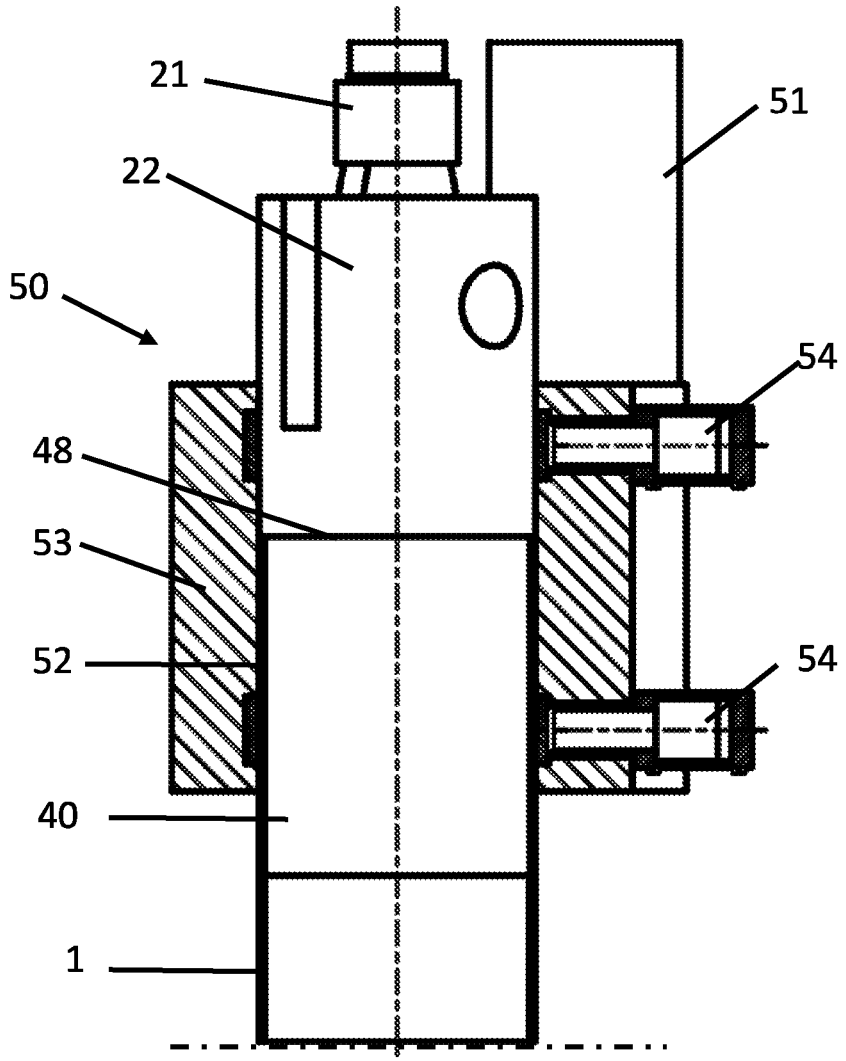
FIG. 25 shows a sectional side view of a detail of the embodiment of FIGS. 22-24.

Each sliding assembly 50 comprises a sleeve 52 (52.1, 52.2, 52.3, 52.4) and one or more gripper actuators 54 (54.1, 54.2, 54.3, 54.4) which can be switched between a gripping state and a released state. In FIG. 25, two gripper actuators 54 are shown above one another. The gripper actuators 54 may act on the pile, or on the pile connector 22, or both.

In the released state of the gripper actuators 54, the pile 1, 2, 3, 4 and/or pile connector 22 can slide through the sleeve 52. The sleeve 52 can exert a bending moment on the pile and/or the pile connector 22, and vice versa, the pile and/or the pile connector 22 can exert a bending moment on the sleeve. This bending moment can be transferred to one or more of the other three piles via the base frame 53 and the other three sleeves 52.

In the gripping state of the gripper actuators 54, the pile in question is firmly gripped and cannot move upward or downward relative to the base frame 53. The base frame 53 can exert both a bending moment and an upward (or downward) force on the pile 1, 2, 3 or 4. Typically, the upward force is primarily relevant for the operation of the device 10, because with the upward force, the pile can be put under a tension force.

The operation of the second embodiment is very similar to the operation of the first embodiment.

Each cycle comprises the following steps in the sequence as indicated:

- pushing a first pile over a distance into the ground or seabed,
- pushing a second pile over a distance into the ground or seabed,
- pushing a third pile over a distance into the ground or seabed,
- pushing a fourth pile which is opposite to the third pile over a distance into the ground or seabed.

The piles can be pushed into the ground or seabed by carrying out multiple cycles.

In the second embodiment, the first, second third and fourth pile can be chosen in any order. In other words, the order can be, when seen in top view, clockwise, anticlockwise, or similar to the order used in the first embodiment.

The regulating of the hydraulic pressures in the actuator which makes the stroke and in the opposite actuator remains the same as for the first embodiment. In other words, for the actuator which is to be extended the hydraulic pressure is higher than for the opposite actuator. This will create a bending moment which needs to be transferred into the two piles on the other diagonal.

Third Embodiment

Figure 26:
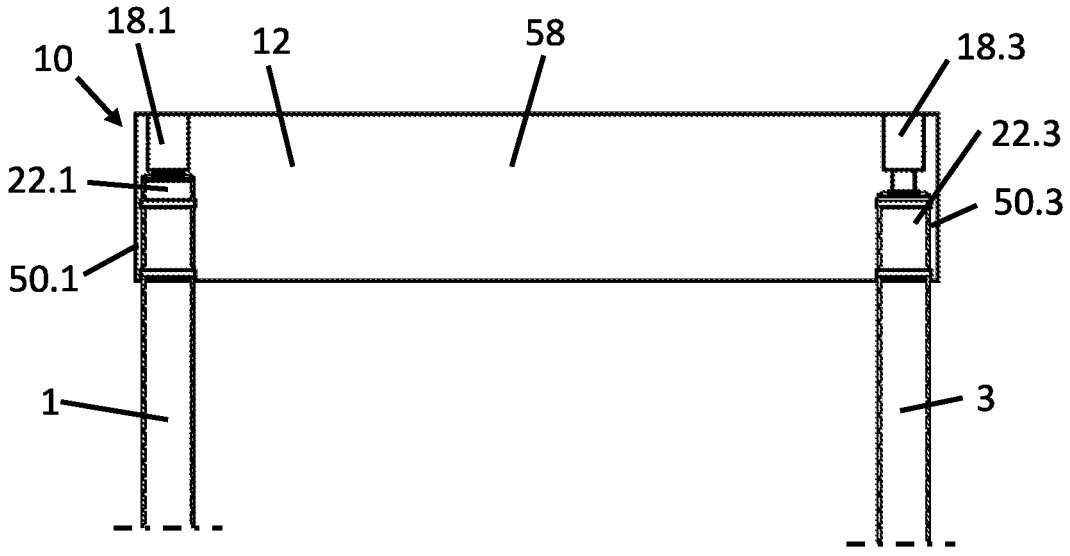
FIG. 26 shows a side view of another embodiment of the invention.
Figure 27:
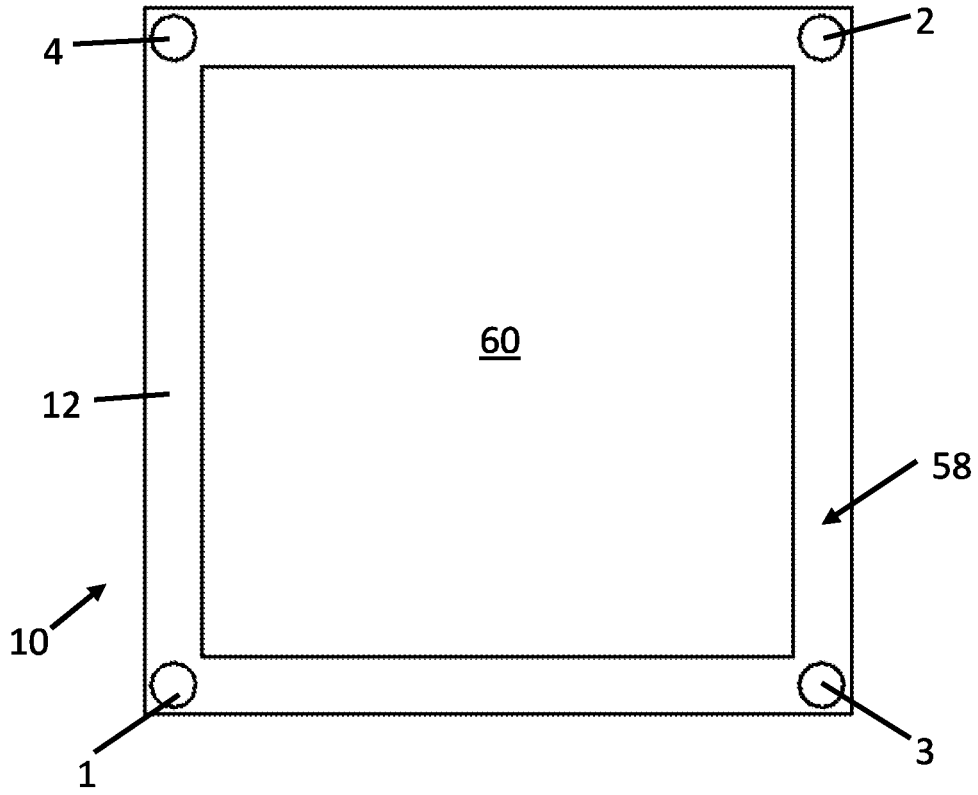
FIG. 27 shows a top view of the embodiment of FIG. 26.
Figure 28:
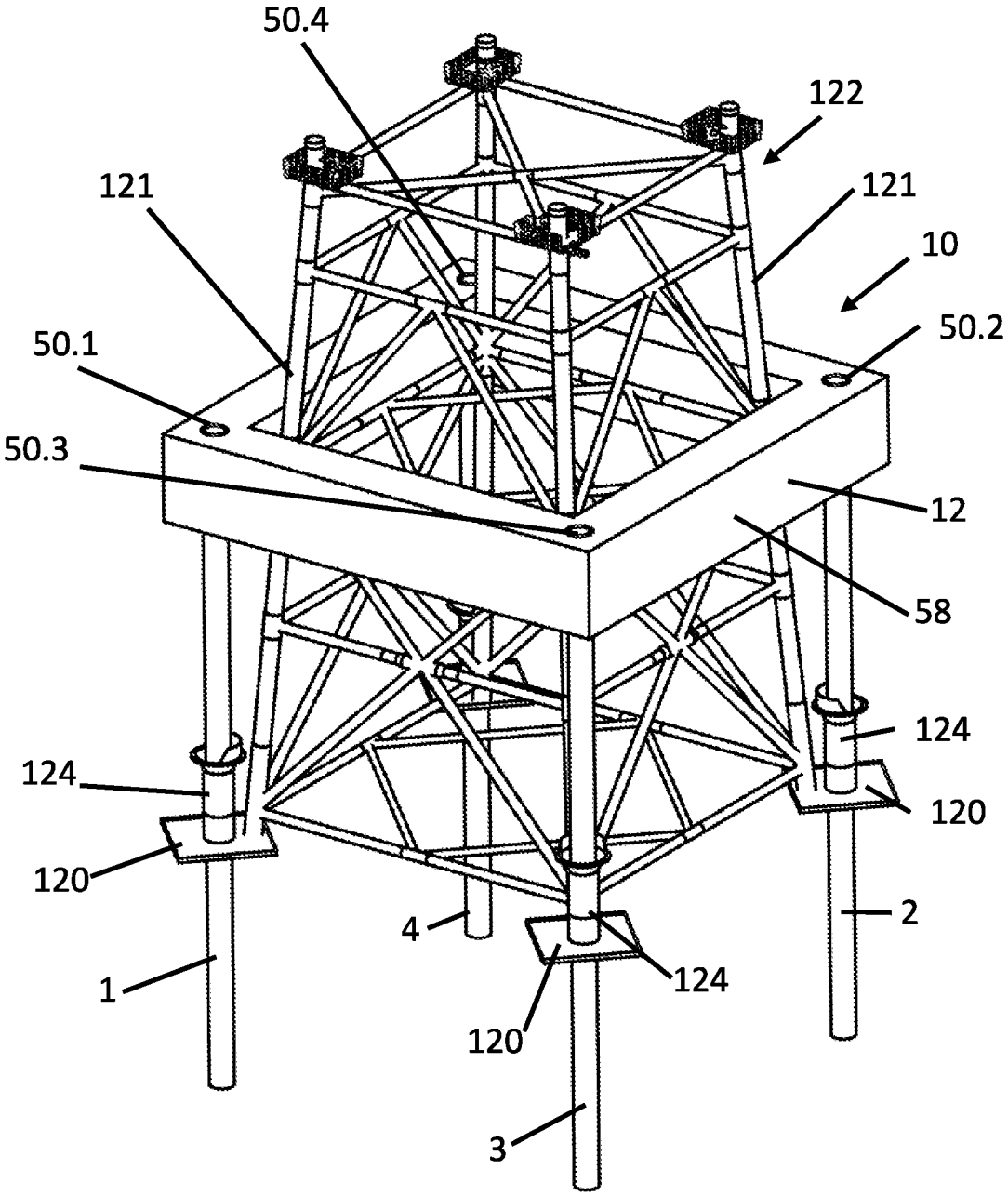
FIG. 28 shows an isometric view of the embodiment of FIGS. 26-27.
Figure 29:
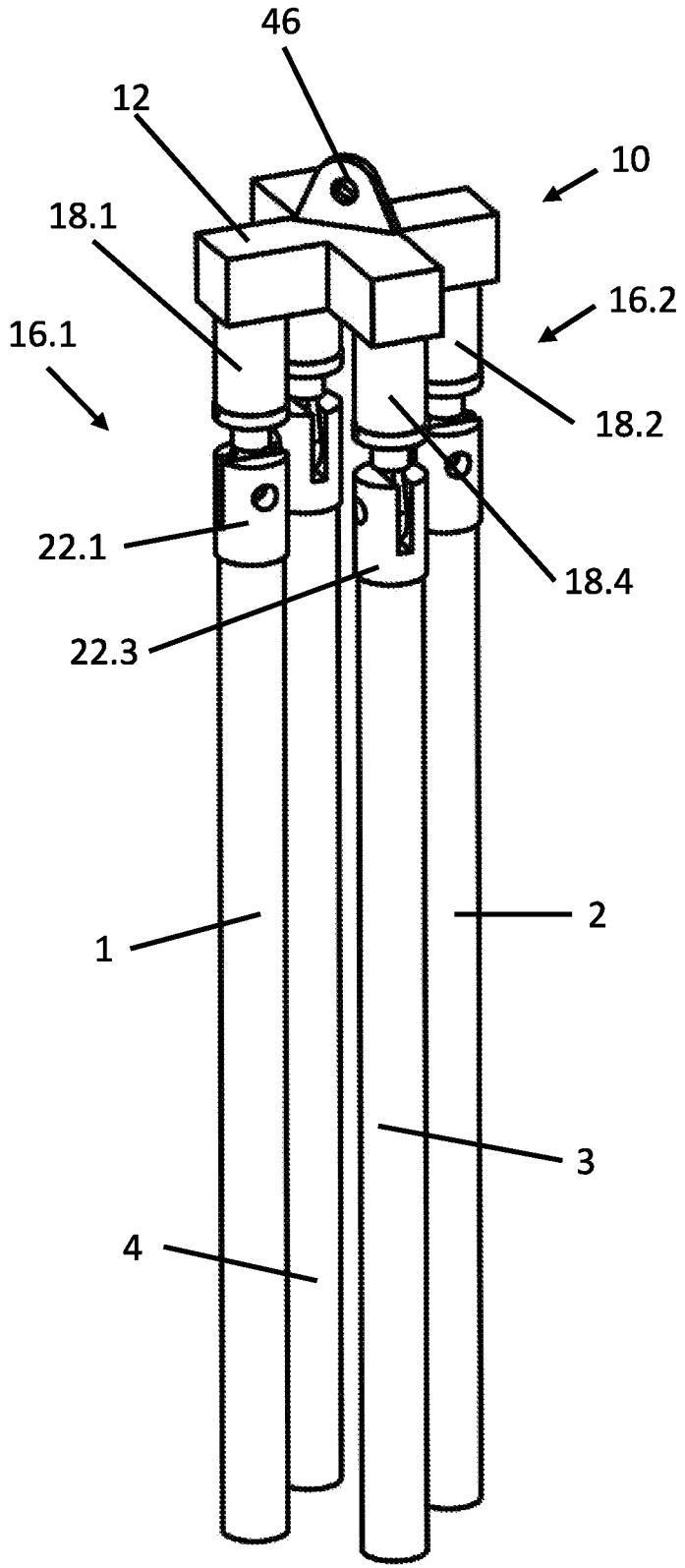
FIG. 29 shows an isometric view of a further embodiment of the invention.
Figure 30:
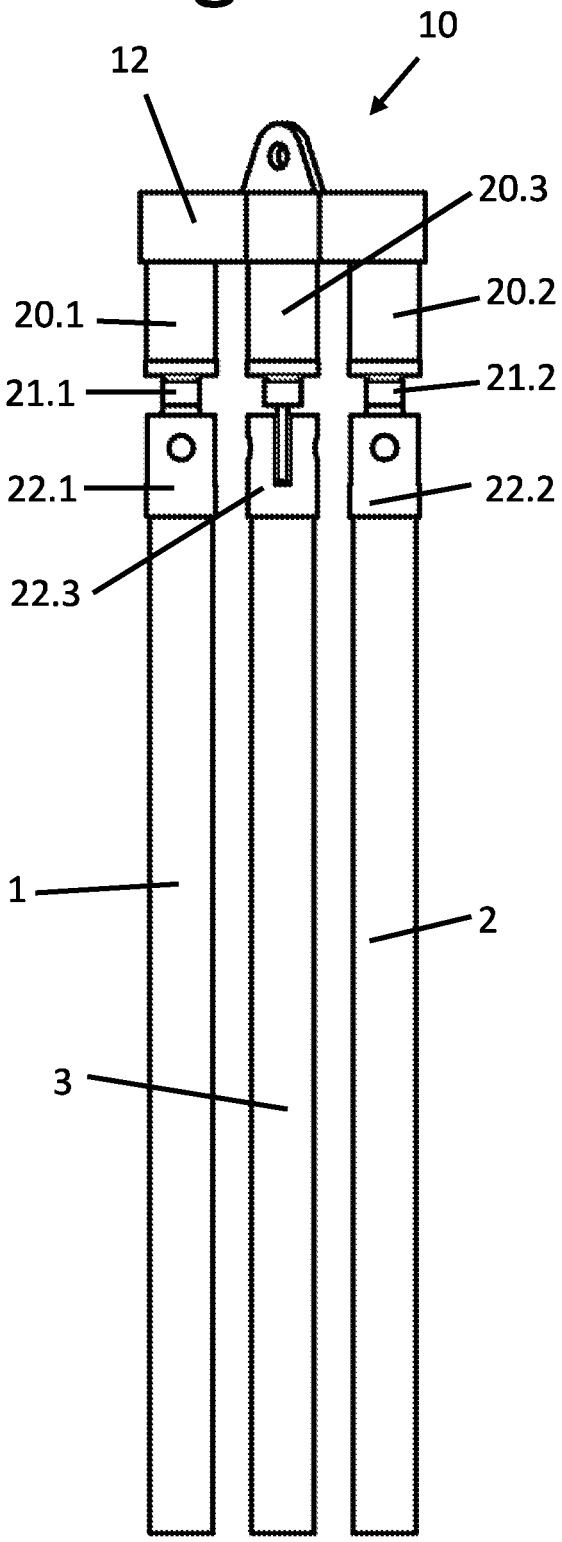
FIG. 30 shows a side view of the embodiment of FIG. 29.
Figure 31:
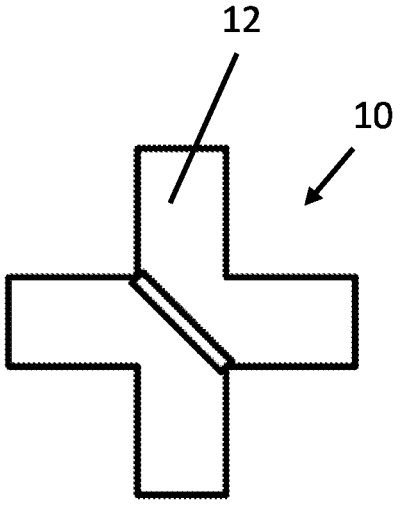
FIG. 31 shows a top view of the embodiment of FIGS. 29-30.

Turning to FIGS. 26, 27 and 28, a third embodiment is shown. This embodiment is quite similar to the second embodiment, with a difference in that the bridge assembly 12 comprises a single frame 58, which in top view has a square or diamond shape, and which has a central opening 60.

The sliding assemblies 50 of the third embodiment are essentially the same as for the second embodiment.

The operation of the third embodiment is also essentially the same as the operation of the second embodiment.

With reference to FIG. 28, the single frame 58 can be positioned over a jacket which has been placed on the seabed earlier. This positioning manoeuvre can be carried out with a crane 114 on board the installation vessel 112. The four piles can be prepositioned before the device 10 is positioned on top of the piles. Alternatively, the four piles can be lifted over the jacket and be positioned on the seabed together with the device 10.

The operation of the third embodiment is the same as the operation of the second embodiment.

Fourth Embodiment

With reference to FIGS. 29-32 and 12, in a fourth embodiment, the four actuators 18 are each configured to transfer both an axial force (compression force and tension force) and a bending moment from the bridge assembly 12 to the respective piles 1, 2, 3, 4 and vice versa.

This configuration has less mechanical parts, but the actuators 18 need to be specifically designed and constructed in order to be able to transfer the bending moments.

Figure 32:
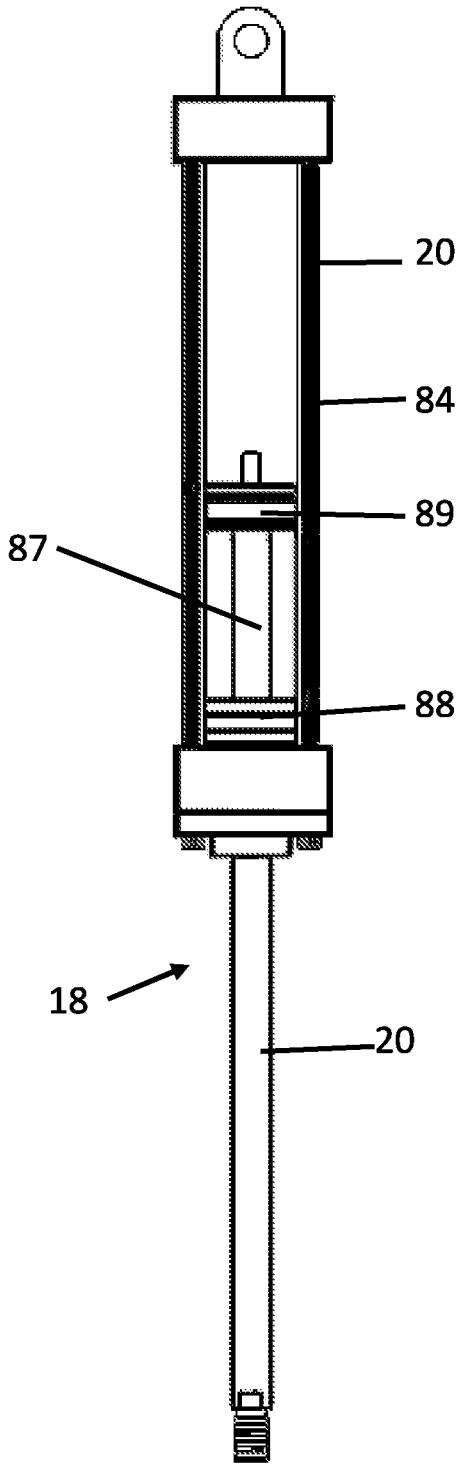
FIG. 32 shows a sectional view of a hydraulic cylinder configured to take bending moments.

In one variant, shown in FIG. 32, each actuator 18 comprises a cylinder 84, a piston rod 87 and a first piston 88 and second piston 89 positioned inside the cylinder and mounted on the piston rod at a distance from one another. The two pistons at a distance from one another allow the transfer of a bending moment.

Figure 12:
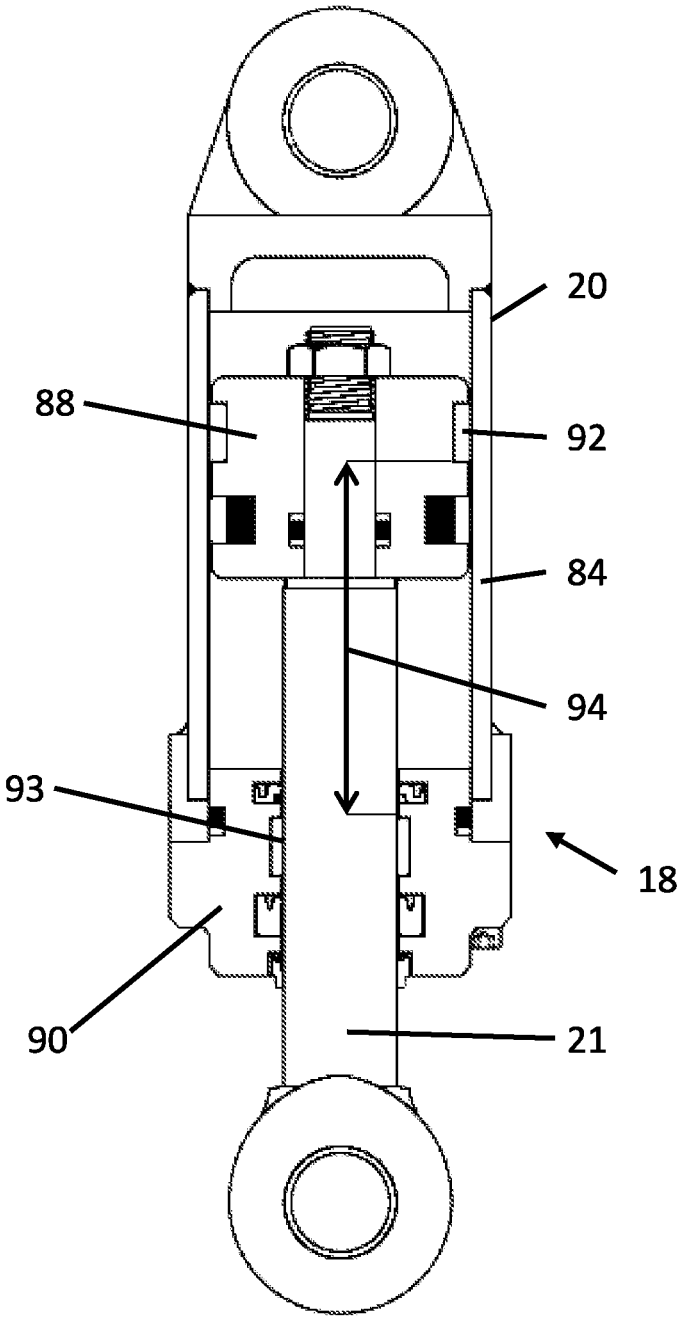
FIG. 12 shows a sectional view of another embodiment of a hydraulic cylinder configured to take bending moments.
Figure 13:
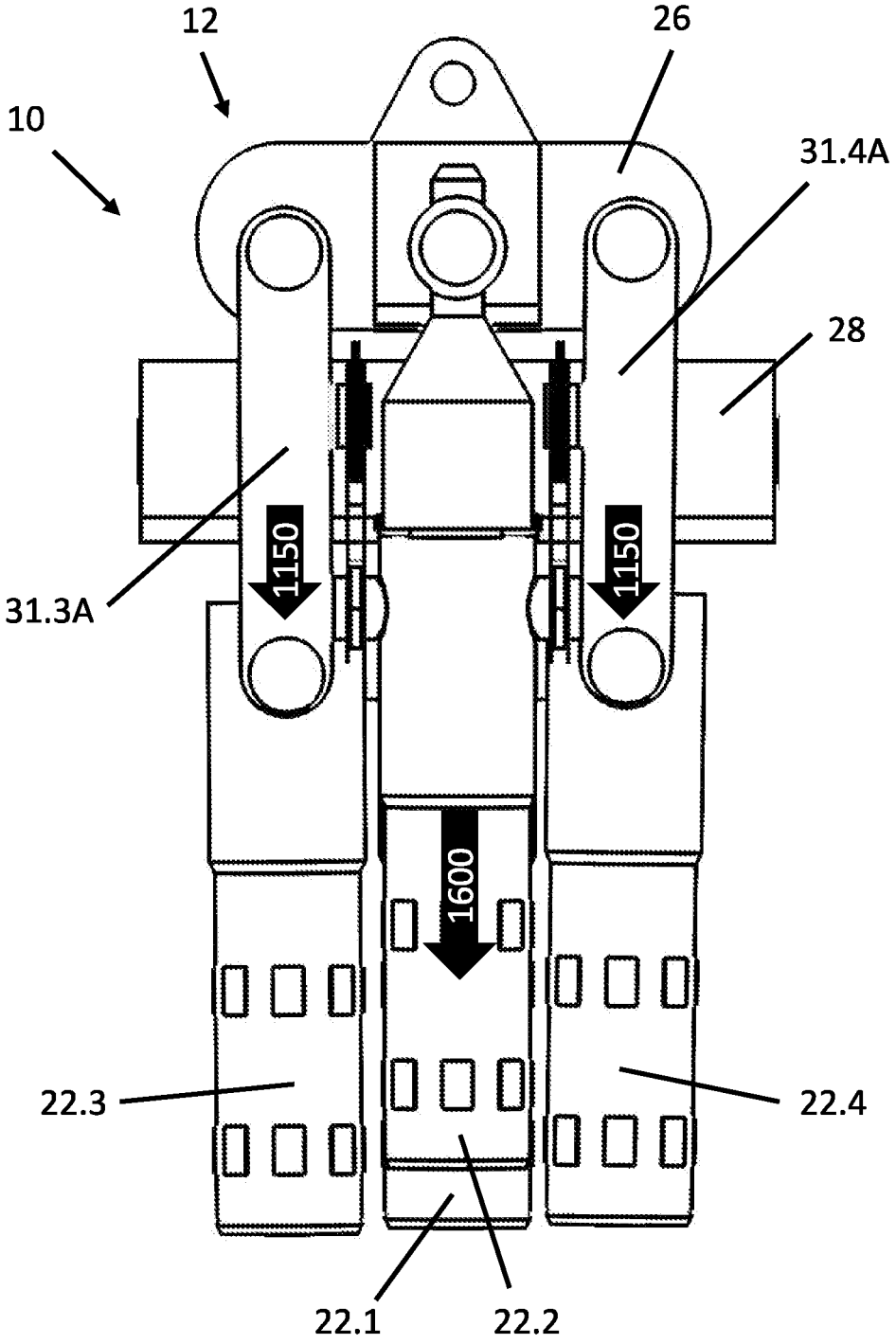
FIGS. 13-16 show side views and front views of the embodiment of FIG. 1 in action.

In another variant, shown in FIG. 12, the piston 88 comprises a piston guide 92 and the rod end 90 of the cylinder comprises a rod guide 93. The piston guide 92 and the rod guide 93 are configured to transfer the lateral forces. A minimum distance 94 between the piston guide 92 and the rod guide 93 (at the outermost position of the rod) is equal than or greater to the diameter of the cylinder. The minimum distance 94 is at least 50 cm at a minimum diameter of the cylinder of 50 cm.

In another variant, each actuator comprises a plurality of linear guides positioned at a lateral distance from one another and extending parallel to the direction in which the actuator extends. The linear guides are rigidly fixed to the upper actuator part 20. The lower actuator part 21 is slideably connected to the linear guides. The linear guides are configured to transfer a bending moment from the upper actuator part to the lower actuator part.

In another variant, each actuator (18) comprises a first sub-actuator and a second sub-actuator positioned adjacent one another.

Figure 33:
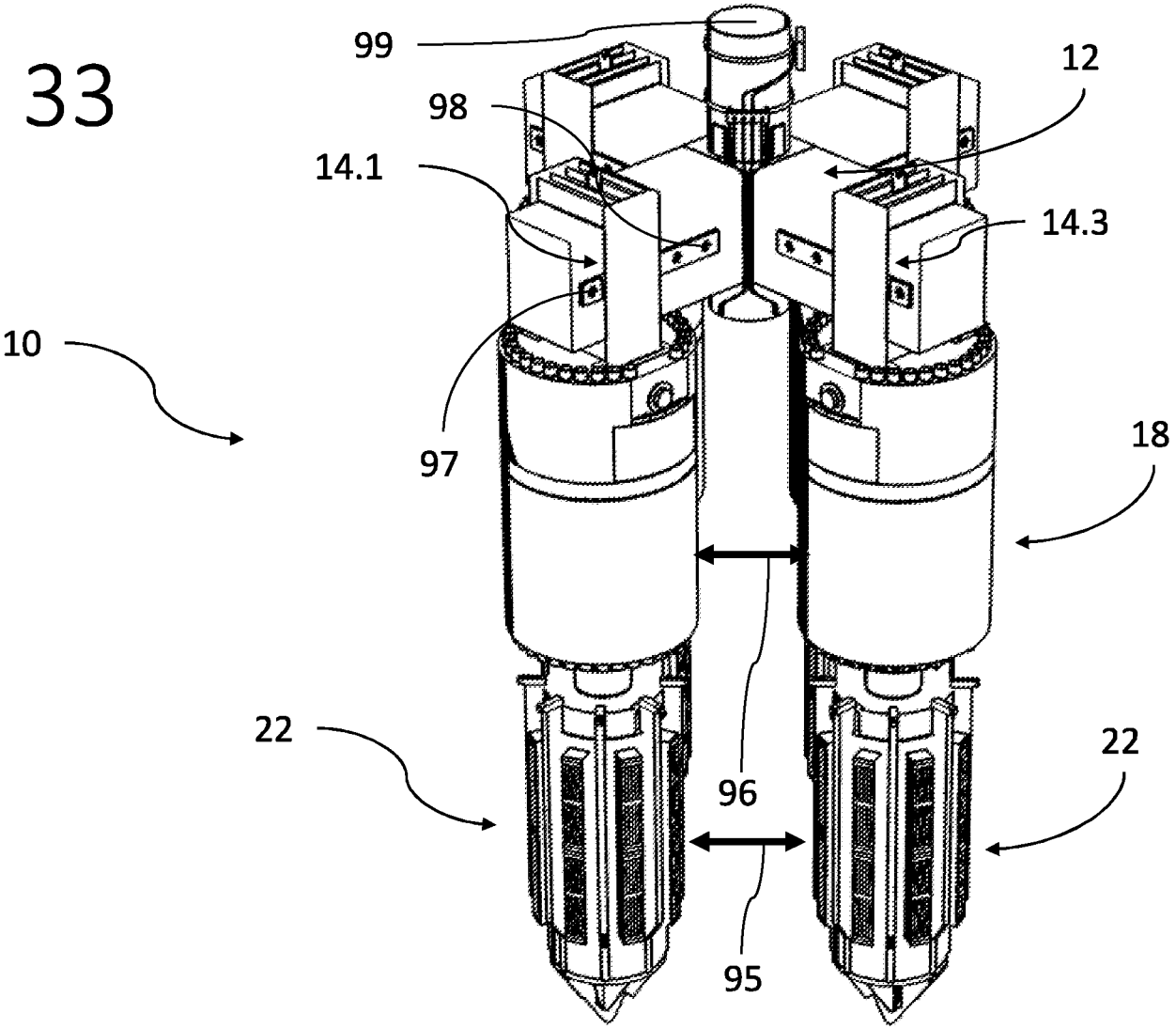
FIG. 33 shows a perspective view of another embodiment of the invention.

FIG. 33 shows a variant, wherein the connecting locations 14 are adjustable between an outer location 97 and an inner location 98 respectively with respect to a centre 99 of the bridge assembly.

General Aspects

The device 10 according to the present invention may be used both on land and at sea.

The device 10 according to the present invention is configured for pushing piles into the ground or seabed which are not interlocked.

The device 10 is configured for pushing piles into the ground or seabed which are positioned at a horizontal distance from one another and do not contact one another. Generally, the piles will be tubular piles having a circular cross-section.

The device 10 may be equipped with suction pumps to reduce friction of the pile being pushed downward and/or to increase the tension capacity of the piles under tension by increasing or decreasing the internal pressure in each pile. In particular, the device 10 may be equipped with valves to increase the tension capacity at the pull side by creating an under pressure inside the piles which are under tension when pulling on the pile.

The device according to the present invention may comprise exactly four pile connectors.

The device according to the present invention is in particular suitable to drive all piles vertically into the ground or seabed. The four actuators and the four pile connectors may be oriented vertically. However, depending on the conditions, the device 10 may also be used to drive piles into the ground or seabed in an inclined orientation.

The bridge assembly moves downward together with the piles as they are pushed into the ground. Ultimately, the bridge assembly may contact the ground, seabed or pile sleeve.

The terms "a" or "an", as used herein, are defined as one or more than one. The term plurality, as used herein, is defined as two or more than two. The term another, as used herein, is defined as at least a second or more. The terms including and/or having, as used herein, are defined as comprising i.e., open language, not excluding other elements or steps.

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

White lines between text paragraphs in the text above indicate that the technical features presented in the paragraph may be considered independent from technical features discussed in a preceding paragraph or in a subsequent paragraph.

The invention claimed is:

1. A device for pushing four piles into a ground or into a seabed in a square configuration or in a diamond configuration, the device comprising:

a bridge assembly which when seen in top view defines a first, second, third and fourth connecting location which are arranged in a square configuration or in a diamond configuration;

a first, a second, a third and a fourth pile connection assembly via which in use each of the four piles is connected to the bridge assembly, wherein each pile connection assembly comprises:

an actuator which extends downward from the respective connecting location, wherein each actuator comprises an upper actuator part and a lower actuator part, wherein the upper actuator part is connected to the bridge assembly, wherein the actuator is configured to extend in order to each time move the lower actuator part downward relative to the upper actuator part in order to push the associated pile over a distance into the ground or seabed; and a pile connector connected to the lower actuator part, wherein each pile connector is configured to be connected to an upper end of a pile which is to be pushed into the ground or seabed, wherein the pile connector is configured to move downward relative to the upper actuator part together with the associated lower actuator part during the extension; and a control device configured for alternately letting each of the actuators extend, wherein the control device is configured for regulating at least a force which is exerted by the actuator which extends and a force which is exerted by the opposite actuator in order to let the pile which is pushed into the ground or seabed receive a greater force than the opposite pile of the square or diamond configuration;

wherein the actuator which extends transfers the exerted push force into the bridge assembly and wherein said push force is transferred at least partially from the bridge assembly as a tension force and a bending moment into the two adjoining piles via the two adjoining pile connection assemblies.

2. The device according to claim 1, wherein the bridge assembly comprises:

a first pivotable frame which is pivotable about a first pivot axis; and a second pivotable frame positioned below the first pivotable frame and being pivotable about a second pivot axis which extends at an angle, in particular at right angles, to the first pivot axis, wherein when seen in top view the first pivotable frame crosses the second pivotable frame;

wherein the first actuator and the second actuator are positioned below the first pivotable frame and are connected with the respective upper actuator parts thereof to the first pivotable frame at the first and second connecting locations;

wherein the third actuator and the fourth actuator are positioned below the second pivotable frame and are connected with the respective upper actuator parts thereof to the second pivotable frame at the third and fourth connecting locations;

wherein each pile connection assembly comprises a pair of connector rods, each pair comprising a right connector rod and a left connector rod, wherein:

the right and left connector rod of the first pile connection assembly are connected to the lower actuator part of the first actuator and to the second pivotable frame;

the right and left connector rod of the second pile connection assembly are connected to the lower actuator part of the second actuator and to the second pivotable frame;

the right and left connector rod of the third pile connection assembly are connected to the lower actuator part of the third actuator and to the first pivotable frame; and the right and left connector rod of the fourth pile connection assembly are connected to the lower actuator part of the fourth actuator and to the first pivotable frame;

wherein each right connector rod is connected to a right side of the associated actuator and each left connector rod is connected to a left side of the associated actuator, wherein each pair of connector rods is configured to transfer a tension force and a bending moment from the bridge assembly into the associated pile.

3. The device according to claim 1, wherein each pile connection assembly comprises a sliding assembly which is rigidly connected to the bridge assembly, wherein the sliding assembly comprises a sleeve and one or more gripper actuators which can be switched between a gripping state and a released state, wherein:

in the released state the pile and/or pile connector can slide through the sleeve; and in the gripping state the sleeve is rigidly connected to the pile and/or pile connector, allowing a tension force and a bending moment to be transferred from the bridge assembly into the pile which is in the sleeve.

4. The device according to claim 3, wherein the pile connection assemblies are rigidly connected to one another via a base frame which is positioned below the bridge assembly and which is rigidly connected to the bridge assembly via at least one column, wherein the sliding assemblies are connected to the base frame.

5. The device according to claim 1, wherein each actuator comprises:

a cylinder, a piston rod and a first piston and second piston positioned inside the cylinder and mounted on the piston rod at a distance from one another; and/or a plurality of linear guides positioned at a lateral distance from one another and extending parallel to the direction in which the cylinder actuator extends wherein the linear guides are configured to transfer a bending moment from the upper actuator part to the lower actuator part;

a cylinder in which a minimum distance between a piston guide and a rod guide is equal to or greater than a diameter of the cylinder; and/or a first sub-actuator, in particular a cylinder, and a second sub-actuator, in particular a cylinder, positioned adjacent one another.

6. The device according to claim 1, wherein in top view the bridge assembly has a square or diamond shape and comprises a central opening, wherein the bridge assembly extends around this central opening.

7. The device according to claim 1, configured for pushing piles which are positioned at a horizontal distance from one another and do not contact one another.

8. The device according to claim 1, wherein each pile connector comprises an insertable part which is configured to be inserted into, the upper ends of tubular piles.

9. The device according to claim 1, comprising exactly four connecting assemblies and exactly four pile connectors.

10. A method of pushing four piles into a ground or into a seabed in a square configuration or in a diamond configuration, the method comprising:

positioning four piles on the ground or on a seabed, in a square or diamond configuration when seen in top view, and connecting the device according to claim 1 to the upper ends of the piles, wherein each pile connection assembly is connected to an associated pile; and alternately pushing each one of the four piles over a distance into the ground or seabed by extending the actuator which is associated with said pile, wherein during the extension the control device regulates the force exerted by the actuator which extends and the force exerted by the opposite actuator in order to let the pile which is pushed into the ground or seabed receive a greater force than the opposite pile of the square or diamond configuration, and wherein an exerted push force is transferred from the respective actuator into the bridge assembly and transferred at least partially from the bridge assembly as a tension force and a bending moment into the two adjoining piles via the two adjoining pile connection assemblies.

11. The method according to the claim 10, further comprising:

connecting the device according to claim 2 to the piles; and alternately pushing in each one of the four piles over a distance into the ground or seabed by extending the cylinder actuator which is associated with said pile, wherein during each pushing step the required push force is transferred from the respective cylinder actuator into the pivotable frame to which the cylinder actuator is connected and from said pivotable frame at least partially as a tension force and a bending moment into two adjacent piles by the connector rods which are connected to said pivotable frame and to the two adjacent piles.

12. The method according to claim 10, wherein a cycle is made, wherein each cycle comprises the following steps in the sequence as indicated:

pushing the first pile over a distance into the ground or seabed;

pushing the second pile which is opposite to the first pile over a distance into the ground or seabed;

pushing the third pile over a distance into the ground or seabed; and pushing the fourth pile which is opposite to the third pile over a distance into the ground or seabed.

13. The method according to claim 10, wherein four piles are pushed into the ground through piles sleeves at each leg of a jacket.

14. A vessel comprising:

the device according to claim 1;

a pile support frame, provided on the vessel, wherein the pile support frame is configured to support four piles in a square or diamond pickup configuration and in a substantially vertical orientation and parallel to one another, wherein the pile support frame is open at an upper side, allowing the four piles to be gripped by the device; and a crane.

15. The vessel according to claim 14, wherein the pile support frame:

is positioned on deck;

is located at least partially below a deck;

comprises a cantilever platform which extends outwardly away from the hull or deck of the vessel; and/or is located at least partially in a column of a semi-sub, wherein the column connects a deck structure with a floater.

* * * * *